US008786658B2

(12) United States Patent
Kubo et al.

(10) Patent No.: US 8,786,658 B2
(45) Date of Patent: Jul. 22, 2014

(54) EXPOSURE DEVICE AND IMAGE FORMING APPARATUS

(71) Applicants: Nobuaki Kubo, Tokyo (JP); Toshiaki Tokita, Kanagawa (JP); Kohji Sakai, Tokyo (JP); Naoto Watanabe, Kanagawa (JP); Tomohiro Nakajima, Kanagawa (JP); Yorichika Ishiyama, Kanagawa (JP)

(72) Inventors: Nobuaki Kubo, Tokyo (JP); Toshiaki Tokita, Kanagawa (JP); Kohji Sakai, Tokyo (JP); Naoto Watanabe, Kanagawa (JP); Tomohiro Nakajima, Kanagawa (JP); Yorichika Ishiyama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/783,898

(22) Filed: Mar. 4, 2013

(65) Prior Publication Data

US 2013/0250029 A1 Sep. 26, 2013

(30) Foreign Application Priority Data

Mar. 26, 2012 (JP) ..... 2012-068657

(51) Int. Cl.
*B41J 15/14* (2006.01)
*B41J 27/00* (2006.01)

(52) U.S. Cl.
USPC ..... 347/242; 347/257

(58) Field of Classification Search
USPC ..... 347/224, 242, 245, 257, 263
See application file for complete search history.

(56) References Cited

U.S. PATENT DOCUMENTS

| | | | | |
|---|---|---|---|---|
| 4,421,386 | A * | 12/1983 | Podgorski | 359/894 |
| 4,853,710 | A | 8/1989 | Shimada et al. | |
| 5,633,744 | A | 5/1997 | Nakajima | |
| 5,753,907 | A | 5/1998 | Nakajima et al. | |
| 5,786,594 | A | 7/1998 | Ito et al. | |
| 5,793,408 | A | 8/1998 | Nakajima | |
| 5,831,758 | A | 11/1998 | Sakai et al. | |
| 5,936,756 | A | 8/1999 | Nakajima | |
| 5,999,345 | A | 12/1999 | Nakajima et al. | |
| 6,052,211 | A | 4/2000 | Nakajima | |
| 6,166,842 | A | 12/2000 | Aoki et al. | |
| 6,256,133 | B1 | 7/2001 | Suzuki et al. | |
| 6,347,004 | B1 | 2/2002 | Suzuki et al. | |
| 6,366,384 | B1 | 4/2002 | Aoki et al. | |
| 6,376,837 | B1 | 4/2002 | Itabashi et al. | |
| 6,388,792 | B1 | 5/2002 | Atsuumi et al. | |
| 6,448,998 | B1 | 9/2002 | Suzuki et al. | |

(Continued)

FOREIGN PATENT DOCUMENTS

| | | |
|---|---|---|
| JP | 60-032019 | 2/1985 |
| JP | 4-180461 | 6/1992 |

(Continued)

*Primary Examiner* — Hai C Pham
(74) *Attorney, Agent, or Firm* — Oblon, Spivak, McClelland, Maier & Neustadt, L.L.P.

(57) ABSTRACT

An exposure device to expose an exposure element includes a light source; an optical system to guide light emitted from the light source to the exposure element; and an optical housing, configured with a plurality of plates, to support the light source and the optical system. At least one of the plurality of plates configuring the optical housing is formed with a plurality of grooves on each of a first face and a second face with a given pitch on the one of the plurality of plates, the first face and the second face being opposite faces with each other. The plurality of grooves are arranged by shifting the center of each of grooves formed on the first face and the center of each of grooves formed on the second face.

8 Claims, 21 Drawing Sheets

(56) References Cited

U.S. PATENT DOCUMENTS

| | | | | |
|---|---|---|---|---|
| 6,509,995 | B1 | 1/2003 | Suzuki et al. | |
| 6,596,985 | B2 | 7/2003 | Sakai et al. | |
| 6,775,041 | B1 | 8/2004 | Nakajima | |
| 7,215,354 | B1 | 5/2007 | Sakai et al. | |
| 8,368,986 | B2 * | 2/2013 | Serizawa et al. | 359/216.1 |
| 2001/0035460 | A1 | 11/2001 | Nakajima et al. | |
| 2002/0001118 | A1 | 1/2002 | Nakajima et al. | |
| 2002/0080428 | A1 | 6/2002 | Suzuki et al. | |
| 2002/0122217 | A1 | 9/2002 | Nakajima | |
| 2002/0163704 | A1 | 11/2002 | Hayashi et al. | |
| 2002/0171878 | A1 | 11/2002 | Nakajima | |
| 2003/0053156 | A1 | 3/2003 | Satoh et al. | |
| 2003/0072066 | A1 | 4/2003 | Hayashi et al. | |
| 2003/0107788 | A1 | 6/2003 | Hayashi et al. | |
| 2003/0128413 | A1 | 7/2003 | Suzuki et al. | |
| 2003/0146375 | A1 | 8/2003 | Ono et al. | |
| 2003/0179429 | A1 | 9/2003 | Takanashi et al. | |
| 2003/0214694 | A1 | 11/2003 | Sakai | |
| 2003/0218788 | A1 | 11/2003 | Sakai et al. | |
| 2004/0032631 | A1 | 2/2004 | Amada et al. | |
| 2004/0036936 | A1 | 2/2004 | Nakajima et al. | |
| 2004/0090520 | A1 | 5/2004 | Sakai et al. | |
| 2004/0125193 | A1 | 7/2004 | Kubo | |
| 2004/0184127 | A1 | 9/2004 | Nakajima et al. | |
| 2004/0263968 | A1 | 12/2004 | Kobayashi et al. | |
| 2005/0030606 | A1 | 2/2005 | Nakajima | |
| 2005/0062836 | A1 | 3/2005 | Nakajima | |
| 2005/0122555 | A1 | 6/2005 | Kondoh et al. | |
| 2005/0185237 | A1 | 8/2005 | Nakajima | |
| 2005/0190420 | A1 | 9/2005 | Imai et al. | |
| 2005/0243396 | A1 | 11/2005 | Fujii et al. | |
| 2006/0028533 | A1 | 2/2006 | Nakajima | |
| 2006/0077500 | A1 | 4/2006 | Hayashi et al. | |
| 2006/0132880 | A1 | 6/2006 | Amada et al. | |
| 2006/0158711 | A1 | 7/2006 | Imai et al. | |
| 2006/0187294 | A1 | 8/2006 | Saisho et al. | |
| 2006/0232844 | A1 | 10/2006 | Nakajima | |
| 2006/0245009 | A1 | 11/2006 | Akiyama et al. | |
| 2007/0035796 | A1 | 2/2007 | Nakajima | |
| 2007/0058232 | A1 | 3/2007 | Nakajima | |
| 2007/0058255 | A1 | 3/2007 | Imai et al. | |
| 2007/0091398 | A1 | 4/2007 | Ueda et al. | |
| 2007/0146738 | A1 | 6/2007 | Nakajima | |
| 2007/0146851 | A1 | 6/2007 | Nakajima | |
| 2007/0146856 | A1 | 6/2007 | Nakajima | |
| 2007/0206259 | A1 | 9/2007 | Nakajima | |
| 2007/0211324 | A1 | 9/2007 | Sakai et al. | |
| 2007/0211326 | A1 | 9/2007 | Saisho et al. | |
| 2007/0253048 | A1 | 11/2007 | Sakai et al. | |
| 2008/0024589 | A1 | 1/2008 | Ueda et al. | |
| 2008/0024590 | A1 | 1/2008 | Nakajima | |
| 2008/0025759 | A1 | 1/2008 | Ichii et al. | |
| 2008/0055672 | A1 | 3/2008 | Watanabe et al. | |
| 2008/0055692 | A1 | 3/2008 | Saisho et al. | |
| 2008/0062491 | A1 | 3/2008 | Nakamura et al. | |
| 2008/0068689 | A1 | 3/2008 | Saisho et al. | |
| 2008/0068693 | A1 | 3/2008 | Hayashi et al. | |
| 2008/0100895 | A1 | 5/2008 | Hayashi et al. | |
| 2008/0123159 | A1 | 5/2008 | Hayashi et al. | |
| 2008/0192319 | A1 | 8/2008 | Miyatake et al. | |
| 2008/0192323 | A1 | 8/2008 | Nakamura et al. | |
| 2008/0204840 | A1 | 8/2008 | Watanabe et al. | |
| 2008/0204852 | A1 | 8/2008 | Amada et al. | |
| 2008/0212156 | A1 | 9/2008 | Nakajima | |
| 2008/0212999 | A1 | 9/2008 | Masuda et al. | |
| 2008/0218827 | A1 | 9/2008 | Watanabe et al. | |
| 2008/0219601 | A1 | 9/2008 | Arai et al. | |
| 2008/0239433 | A1 | 10/2008 | Amada et al. | |
| 2008/0285104 | A1 | 11/2008 | Arai et al. | |
| 2009/0015897 | A1 | 1/2009 | Nakamura et al. | |
| 2009/0052944 | A1 | 2/2009 | Kubo et al. | |
| 2009/0059333 | A1 | 3/2009 | Sakai | |
| 2009/0060583 | A1 | 3/2009 | Amada et al. | |
| 2009/0065685 | A1 | 3/2009 | Watanabe et al. | |
| 2009/0153933 | A1 | 6/2009 | Tsuchiya et al. | |
| 2009/0195636 | A1 | 8/2009 | Arai et al. | |
| 2009/0225148 | A1 | 9/2009 | Itami et al. | |
| 2009/0225383 | A1 | 9/2009 | Soeda et al. | |
| 2009/0231557 | A1 | 9/2009 | Kubo | |
| 2009/0314927 | A1 | 12/2009 | Tatsuno et al. | |
| 2010/0060710 | A1 | 3/2010 | Kubo | |
| 2010/0060963 | A1 | 3/2010 | Miyake et al. | |
| 2010/0091083 | A1 | 4/2010 | Itami et al. | |
| 2010/0118366 | A1 | 5/2010 | Tokita et al. | |
| 2010/0183337 | A1 | 7/2010 | Kubo et al. | |
| 2010/0194843 | A1 | 8/2010 | Sakai et al. | |
| 2010/0266313 | A1 | 10/2010 | Nakajima | |
| 2010/0328417 | A1 | 12/2010 | Saisho et al. | |
| 2011/0002025 | A1 | 1/2011 | Tokita et al. | |
| 2011/0058230 | A1 | 3/2011 | Soeda et al. | |
| 2011/0063594 | A1 | 3/2011 | Sakai | |
| 2011/0090549 | A1 | 4/2011 | Sakai | |
| 2011/0216386 | A1 | 9/2011 | Watanabe et al. | |
| 2011/0235132 | A1 | 9/2011 | Saisho et al. | |
| 2011/0316959 | A1 | 12/2011 | Saisho et al. | |
| 2011/0318057 | A1 | 12/2011 | Watanabe | |
| 2012/0044316 | A1 | 2/2012 | Amada et al. | |
| 2012/0050444 | A1 | 3/2012 | Sakai | |
| 2012/0177409 | A1 | 7/2012 | Arai et al. | |
| 2012/0293849 | A1 | 11/2012 | Nakajima | |
| 2013/0016171 | A1 | 1/2013 | Nakamura et al. | |

FOREIGN PATENT DOCUMENTS

| | | | | |
|---|---|---|---|---|
| JP | 4-182937 | | 6/1992 | |
| JP | 6-050739 | | 2/1994 | |
| JP | 7-144434 | | 6/1995 | |
| JP | 11-202252 | | 7/1999 | |
| JP | 2001-235699 | | 8/2001 | |
| JP | 2002-023095 | | 1/2002 | |
| JP | 2002023095 | A * | 1/2002 | G02B 26/10 |
| JP | 2005-138442 | | 6/2005 | |
| JP | 2007-279670 | | 10/2007 | |
| JP | 2010-160295 | | 7/2010 | |

* cited by examiner

EXPOSURE DEVICE AND IMAGE FORMING APPARATUS

CROSS-REFERENCE TO RELATED APPLICATION

This application claims priority pursuant to 35 U.S.C. §119 to Japanese Patent Application No. 2012-068657, filed on Mar. 26, 2012 in the Japan Patent Office, the disclosure of which is incorporated by reference herein in its entirety.

BACKGROUND

1. Technical Field

The present invention relates to an exposure device and an image forming apparatus, and more particularly to an exposure device having an optical housing, and an image forming apparatus having the exposure device.

2. Background Art

In the field of image forming technologies using electrophotography, typical image forming apparatuses include an exposure device, a photoconductor drum, and an optical deflector such as a polygon mirror. In such image forming apparatuses, the exposure device scans the photoconductor drum along the axial direction using a laser beam while rotating the photoconductor drum to form a latent image on the photoconductor drum.

With advances in technology, image forming apparatuses having color printing and high-speed printing capabilities have been introduced into the market. In line with such market trends, image forming apparatuses equipped with a plurality of photoconductor drums (typically four) have been introduced. Such tandem-type image forming apparatuses are larger in size due to the increase in the number of photoconductor drums. However, increasingly the market also demands more compact image forming apparatuses, including a concomitant demand for smaller, thinner exposure devices.

For example, JP-S60-32019-A, JP-H07-144434-A, and JP-2010-160295-A disclose configurations to reduce the size and thickness of the exposure device by partially overlapping optical paths of a plurality of laser beams directed from the optical deflector onto each one of the photoconductor drums.

In such image forming apparatuses, when a latent image is formed on a surface of the photoconductor drum, rotation of the optical deflector causes vibrations that result in deformation of the optical housing of the exposure device. Such deformation causes stripes or banding to appear on the output images.

Various methods have been proposed to suppress the vibrations at the exposure device. For example, JP-4299103-B (JP-2005-138442-A) discloses an optical scanner having a housing made of sheet metal that encases optical parts. Attachments are disposed on the bottom face of the housing at at least two places along the long side of the optical parts at positions corresponding to nodes of vibration. An optical part supporting member that supports the optical parts is attached at the attachments to isolate the optical part supporting member from the bottom face of the housing while attached to the nodes of vibration.

Moreover, there is an additional source of vibration. When forming a latent image on the surface of a photoconductor drum, vibrations from mechanical parts disposed in the image forming apparatus are transmitted to the exposure device. By reducing the size of the exposure device, the size of optical elements included in the exposure device also becomes smaller, and thereby the optical elements are more vulnerable to external vibrations. Further, by reducing the thickness of the exposure device, the rigidity and natural frequency of the optical housing are decreased, making the optical housing more likely to resonate with external vibrations. As a result, the vibrations of the optical elements and vibrations of the optical housing are more likely to be superimposed, resulting in marked deterioration of image quality.

The configuration of the optical scanner disclosed in JP-4299103-B (JP-2005-138442-A) can suppress the effects of vibration on the exposure device. However, it is difficult to design the optical housing to locate the nodes at a given position, and also difficult to dispose the optical elements exactly at the nodes.

SUMMARY

As one aspect of the present invention, an exposure device to expose an exposure element is devised. The exposure device includes a light source; an optical system to guide light emitted from the light source to the exposure element; and an optical housing, configured with a plurality of plates, to support the light source and the optical system. At least one of the plurality of plates configuring the optical housing is formed with a plurality of grooves on each of a first face and a second face with a given pitch on the one of the plurality of plates, the first face and the second face being opposite faces with each other. The plurality of grooves is arranged by shifting the center of each of the grooves formed on the first face and the center of each of the grooves formed on the second face.

BRIEF DESCRIPTION OF THE DRAWINGS

A more complete appreciation of the disclosure and many of the attendant advantages and features thereof can be readily obtained and understood from the following detailed description with reference to the accompanying drawings, wherein.

Figure 1:
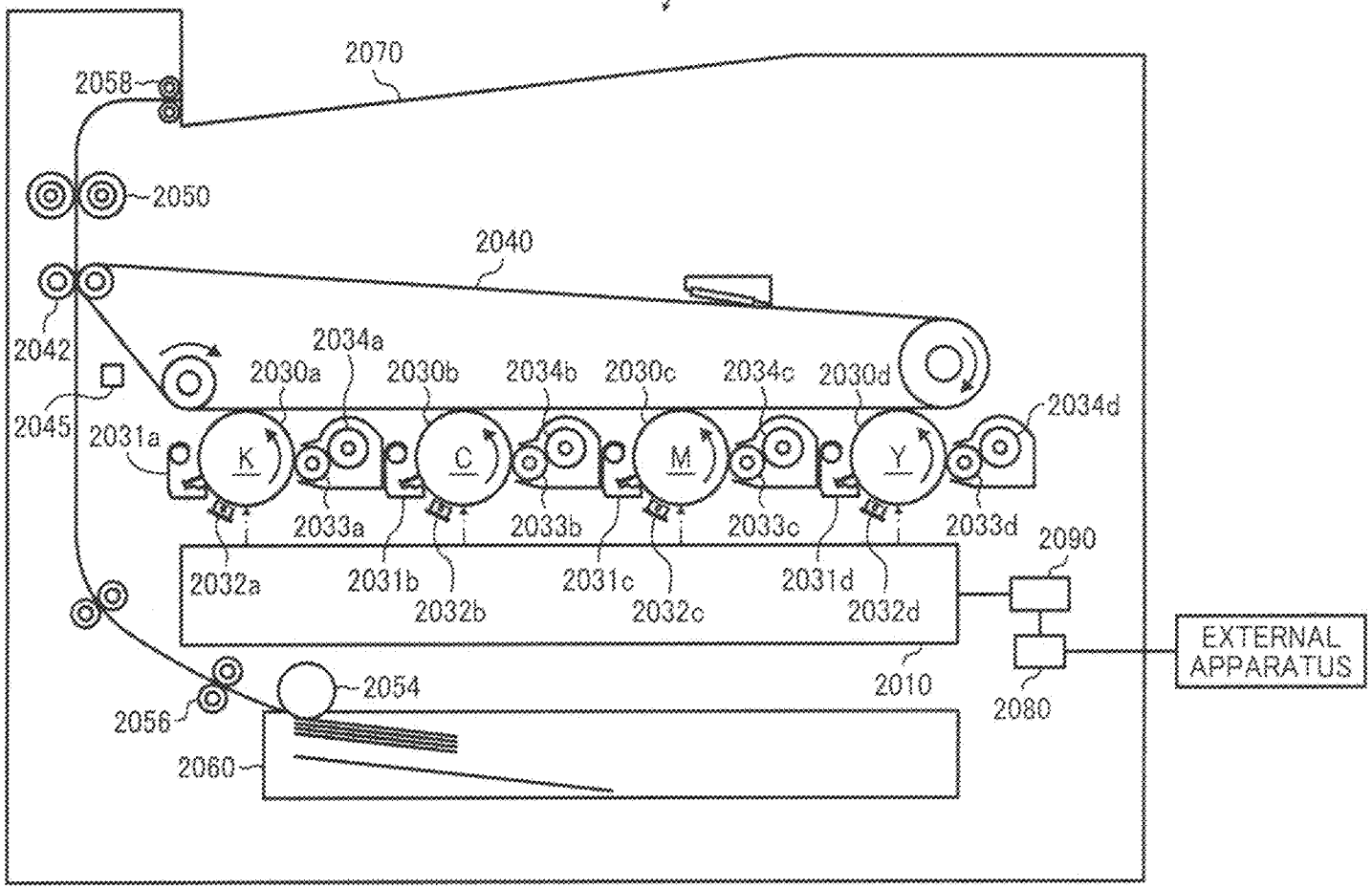
FIG. 1 shows a schematic configuration of an image forming apparatus according to an example embodiment.

The accompanying drawings are intended to depict exemplary embodiments of the present invention and should not be interpreted to limit the scope thereof. The accompanying drawings are not to be considered as drawn to scale unless explicitly noted, and identical or similar reference numerals designate identical or similar components throughout the several views.

DETAILED DESCRIPTION

A description is now given of exemplary embodiments of the present invention. It should be noted that although such terms as first, second, etc. may be used herein to describe various elements, components, regions, layers and/or sections, it should be understood that such elements, components, regions, layers and/or sections are not limited thereby because such terms are relative, that is, used only to distinguish one element, component, region, layer or section from another region, layer or section. Thus, for example, a first element, component, region, layer or section discussed below could be termed a second element, component, region, layer or section without departing from the teachings of the present invention.

In addition, it should be noted that the terminology used herein is for the purpose of describing particular embodiments only and is not intended to be limiting of the present invention. Thus, for example, as used herein, the singular forms "a", "an" and "the" are intended to include the plural forms as well, unless the context clearly indicates otherwise. Moreover, the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Furthermore, although in describing views shown in the drawings, specific terminology is employed for the sake of clarity, the present disclosure is not limited to the specific terminology so selected and it is to be understood that each specific element includes all technical equivalents that, have a similar function, operate in a similar manner, and achieve a similar result. Referring now to the drawings, apparatuses or systems according to example embodiments are described hereinafter.

A description is given of an image forming apparatus according to an example embodiment with reference to FIGS. 1 to 29. FIG. 1 shows a schematic configuration of an image forming apparatus 2000 such as a color printer according to an example embodiment.

The image forming apparatus 2000 is, for example, a tandem type color printer to form color images by superimposing four colors of black, cyan, magenta, and yellow. The image forming apparatus 2000 includes, for example, an optical scan unit 2010, four photoconductor drums 2030*a*, 2030*b*, 2030*c*, 2030*d* used as image carriers or image bearing members, four cleaning units 2031*a*, 2031*b*, 2031*c*, 2031*d*, four chargers 2032*a*, 2032*b*, 2032*c*, 2032*d*, four development rollers 2033*a*, 2033*b*, 2033*c*, 2033*d*, a transfer belt 2040, a transfer roller 2042, a fusing roller 2050, a sheet feed roller 2054, a sheet ejection roller 2058, a sheet feed tray 2060, a sheet ejection tray 2070, a communication controller 2080, and a main controller 2090 that controls such unit as a whole. Such units are encased in a housing of the image forming apparatus 2000.

The communication controller 2080 controls bi-directional communications with an external apparatus such as a personal computer via a network.

The main controller 2090 includes, for example, a central processing unit (CPU), a read only memory (ROM), a random access memory (RAM), an amplification circuit, and an analog/digital (A/D) converter. The ROM stores programs codes decode-able by the CPU and various data for executing the programs. The RAM is used as a working memory. The A/D converter converts analog data to digital data. The main controller 2090 controls each unit in response to demands or requests from the external apparatus, and transmits multicolor image data received from the external apparatus to the optical scan unit 2010.

The photoconductor drum 2030*a*, the charger 2032*a*, the development roller 2033*a*, and the cleaning unit 2031 are used an image forming station to form black images (hereinafter, K station).

The photoconductor drum 2030*b*, the charger 2032*b*, the development roller 2033*b*, and the cleaning unit 2031*b* are used an image forming station to form cyan images (hereinafter, C station).

The photoconductor drum 2030*c*, the charger 2032*c*, the development roller 2033*c*, and the cleaning unit 2031*c* are used an image forming station to form magenta images (hereinafter, M station).

The photoconductor drum 2030*d*, the charger 2032*d*, the development roller 2033*d*, and the cleaning unit 2031*d* are used an image forming station to form yellow images (hereinafter, Y station).

Each of the photoconductor drums includes a photoconductive layer as its top face. As such, the surface of the photoconductor drum is used as a scan face. Each of the photoconductor drums can be rotated in a direction shown by an arrow in FIG. 1 using a rotation mechanism for the photoconductor drum.

The charger charges the surface of the photoconductor drum uniformly.

The optical scan unit 2010 is used as an exposure device. The optical scan unit 2010 scans the surface of the each of the photoconductor drums, charged by the charger, using light modulated based on image data such as black, cyan, magenta, and yellow image data received from the main controller 2090. Then, a latent image corresponding to each image data is formed on each of the photoconductor drums. Such latent image moves to the development roller with a rotation of the photoconductor drum. The optical scan unit 2010 will be described later in detail.

As the development roller rotates, corresponding color toner is applied on the surface of the development roller as a uniform thin layer from a corresponding toner cartridge. When the toner on the development roller contacts the surface of the photoconductor drum, the toner is transferred and adhered onto the light exposed face of the photoconductor drum. As such, the latent image formed on the photoconductor drum is developed by toner supplied from the development roller. The toner image moves toward the transfer belt 2040 as the photoconductor drum rotates.

The toner images of yellow, magenta, cyan, and black are sequentially transferred onto the transfer belt 2040 at a given timing, and superimposed to form a color image.

The sheet feed tray 2060 stores recording sheets. The sheet feed roller 2054 disposed near the sheet feed tray 2060 feeds out the recording sheets from the sheet feed tray 2060 one by one. The recording sheet is then fed to a space between the transfer belt 2040 and the transfer roller 2042 at a given timing to transfer the color image from the transfer belt 2040 to the recording sheet. The recording sheet transferred with the color image is transported to the fusing roller 2050.

The fusing roller 2050 applies heat and pressure to the recording sheet to fuse the toner on the recording sheet. The recording sheet fused with the toner is transported to the sheet ejection tray 2070 via the sheet ejection roller 2058, and stacked on the sheet ejection tray 2070.

Each of the cleaning units removes toner remaining on the photoconductor drum. Upon removing the remaining toner, the surface of the photoconductor drum is faced to the charger again.

Figure 2:
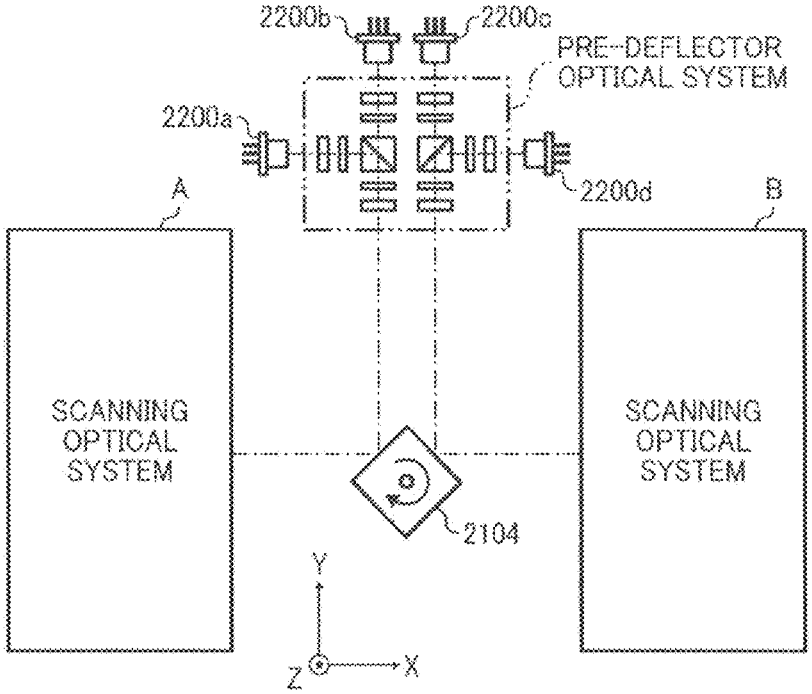
FIG. 2 shows an optical scanner used for the image forming apparatus of FIG. 1.
Figure 15:
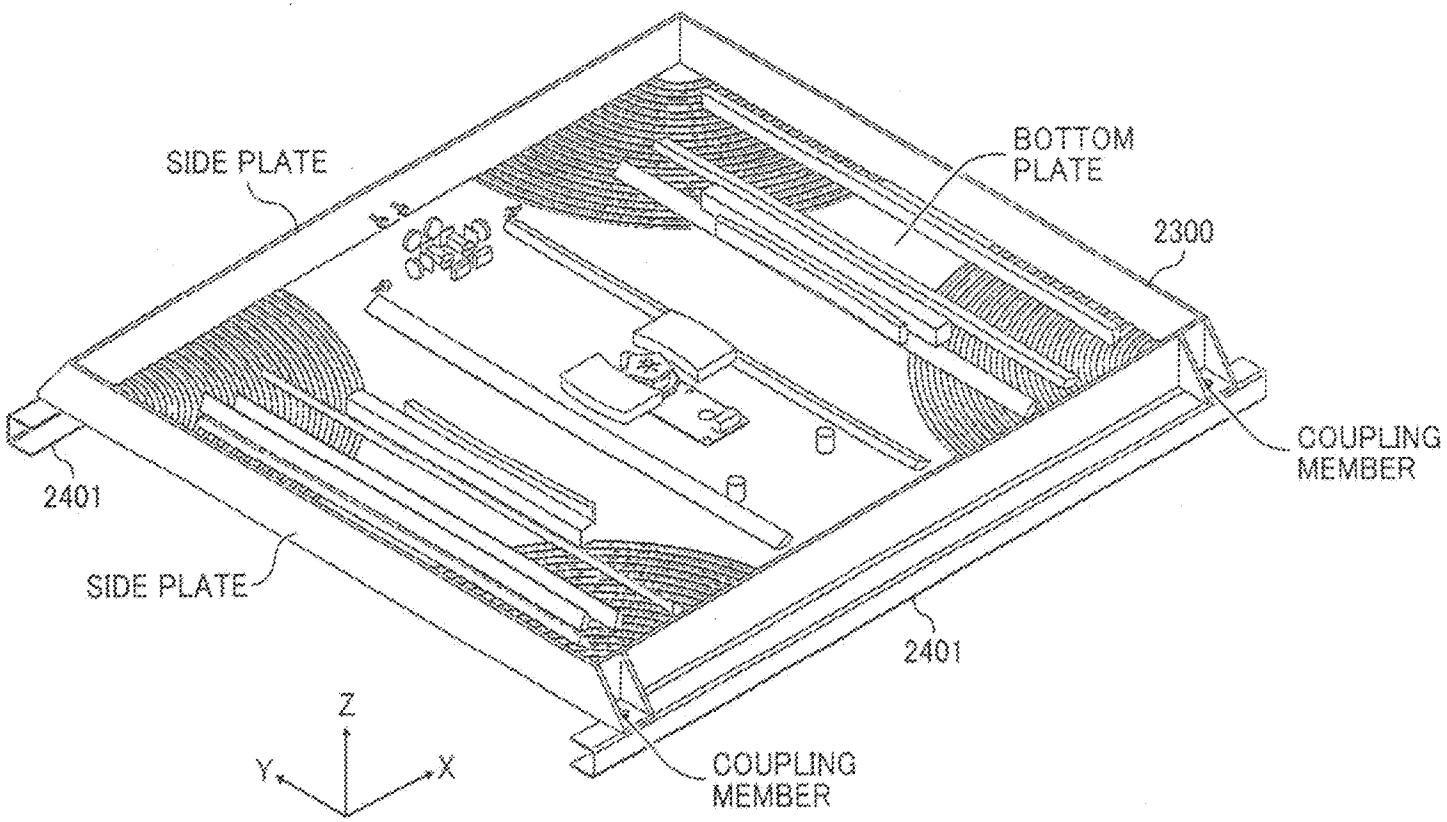
FIG. 15 shows an perspective view of an optical housing.

A description is given of the optical scan unit 2010. The optical scan unit 2010 includes, for example, four light sources 2200*a*, 2200*b*, 2200*c*, 2200*d*, a pre-deflector optical system, which is disposed before a deflector, a polygon mirror 2104 used as a deflector that deflects light, a scanning optical system A , a scanning optical system B, and a scan controller as shown in FIG. 2. Such units are encased in an optical housing 2300 as shown in FIG. 15.

In the three dimensional orthogonal coordinate system of X, Y, Z, the long side direction or rotation axis direction of each of the photoconductor drums is set as Y axis direction, and the direction along a rotation axis of the polygon mirror 2104 is set as Z axis direction. Further, when the direction is required to be referred for each optical part, the main scanning direction and the sub-scanning direction are used.

Each of the light sources includes a semiconductor laser such as a laser diode (LD). The light source 2200*b* and the light source 2200*c* are separated in the X axis direction, and emit lights in the −Y direction. The light source 2200*a* and the light source 2200*d* are opposed with each other in the X axis direction, and the light source 2200*a* emits light in the +X direction, and the light source 2200*d* emits light in the −X direction.

Figure 3:
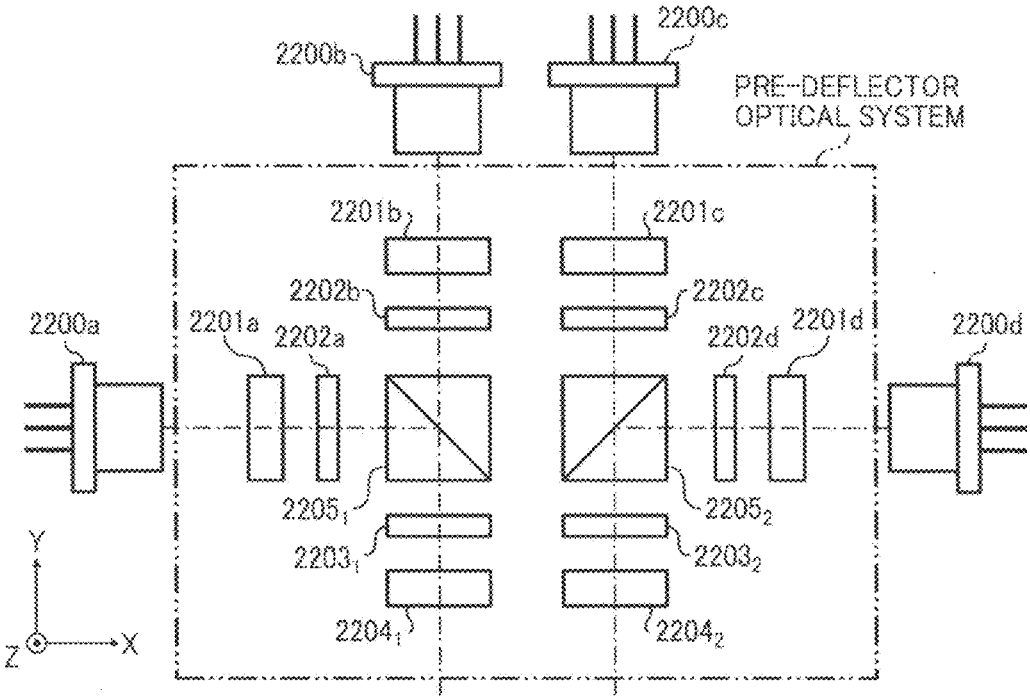
FIG. 3 shows a pre-deflector optical system shown in FIG. 2.

As shown in FIG. 3, the pre-deflector optical system includes, for example, four coupling lenses 2201*a*, 2201*b*, 2201*c*, 2201*d*, four half-wave plates 2202*a*, 2202*b*, 2202*c*, 2202*d*, two polarization beam splitters $\mathbf{2205}_1$, $\mathbf{2205}_2$, two aperture plates $\mathbf{2203}_1$, $\mathbf{2203}_2$ , and two cylindrical lenses $\mathbf{2204}_1$, $\mathbf{2204}_2$.

The coupling lens 2201*a* is disposed on the optical path of light emitted from the light source 2200*a*, and such light is used as substantially parallel light (hereinafter, "light LBa").

The coupling lens 2201*b* is disposed on the optical path of light emitted from the light source 2200*b*, and such light is used as substantially parallel light (hereinafter, "light LBb").

The coupling lens 2201*c* is disposed on the optical path of light emitted from the light source 2200*c*, and such light is used as substantially parallel light (hereinafter, "light LBc").

The coupling lens 2201*d* is disposed on the optical path of light emitted from the light source 2200*d*, and such light is used as substantially parallel light (hereinafter, "light LBd").

The half-wave plate 2202*a* is disposed on the optical path of the light LBa via the coupling lens 2201*a*, and such light is used as s-polarized light with respect to an incidence plane of the polarization beam splitters $\mathbf{2205}_1$.

The half-wave plate 2202*b* is disposed on the optical path of the light LBb via the coupling lens 2201*b*, and such light is used as p-polarized light with respect to the incidence plane of the polarization beam splitters $\mathbf{2205}_1$.

The half-wave plate 2202*c* is disposed on the optical path of the light LBc via the coupling lens 2201*c*, and such light is used as p-polarized light with respect to an incidence plane of the polarization beam splitters $\mathbf{2205}_2$.

The half-wave plate 2202*d* is disposed on the optical path of the light LBd via the coupling lens 2201*d*, and such light is used as s-polarized light with respect to the incidence plane of the polarization beam splitters $\mathbf{2205}_2$.

The polarization beam splitters $\mathbf{2205}_1$ is disposed at +X side of the half-wave plate 2202*a* and −Y side of the half-wave plate 2202*b*. The polarization beam splitter $\mathbf{2205}_1$ has a property that passes through p-polarized light, and reflects s-polarized light. Therefore, the polarization beam splitters $\mathbf{2205}_1$ reflects the light LBa that has passed through the half-wave plate 2202*a* in the −Y direction, and passes through the light LBb that has passed through the half-wave plate 2202*b*. Further, the optical path of the light LBa emitted from the polarization beam splitters $\mathbf{2205}_1$ and the optical path of the light LBb emitted from the polarization beam splitters $\mathbf{2205}_1$ become almost the same optical path, in which the polarization beam splitter $\mathbf{2205}_1$ synthesizes two lights.

The polarization beam splitters $\mathbf{2205}_2$ is disposed at −X side of the half-wave plate 2202*d* and −Y side of the half-wave plate 2202*c*. The polarization beam splitters $\mathbf{2205}_2$ has a property that passes through p-polarized light and reflects s-polarized light. Therefore, the polarization beam splitters $\mathbf{2205}_2$ reflects the light LBd that has passed through the half-wave plate 2202*d* in the −Y direction, and passes through the light LBc that has passed through the half-wave plate 2202*c*. Further, the optical path of the light LBc emitted from the polarization beam splitters $\mathbf{2205}_2$ and the optical path of the light LBd emitted from the polarization beam splitters $\mathbf{2205}_2$ become almost the same optical path, in which the polarization beam splitter $\mathbf{2205}_2$ synthesizes two lights.

The aperture plate $\mathbf{2203}_1$ includes an aperture to adjust the beam shape of the light LBa and the light LBb coming from the polarization beam splitters $\mathbf{2205}_1$.

The aperture plate $\mathbf{2203}_2$ includes an aperture to adjust the beam shape of the light LBc and the light LBd coming from the polarization beam splitters $\mathbf{2205}_2$.

The cylindrical lens $\mathbf{2204}_1$ focuses the light LBa and the light LBb that have passed through the aperture of the aperture plate 22031 near a reflection face of the polygon mirror

2104 in the Z axis direction. As such, the cylindrical lens $\mathbf{2204}_1$ forms a line image on the reflection face of the polygon mirror 2104.

The cylindrical lens $\mathbf{2204}_2$ focuses the light LBc and the light LBd that have passed through the aperture of the aperture plate $\mathbf{2203}_2$ near a reflection face of the polygon mirror 2104 in the Z axis direction. As such, the cylindrical lens $\mathbf{2204}_2$ forms a line image on the reflection face of the polygon mirror 2104.

The polygon mirror 2104 has, for example, four minor faces, and each mirror face is used as a reflection face. The polygon minor 2104 rotates with a uniform speed about a mirror rotation axis parallel to the Z axis direction, and deflects lights coming from each of the cylindrical lens.

The light LBa and the light LBb coming from the cylindrical lens $\mathbf{2204}_1$ are deflected to the −X side of the polygon mirror 2104, and the light LBc and the light LBd coming from the cylindrical lens $\mathbf{2204}_2$ are deflected to the +X side of the polygon minor 2104. Further, a light flux plane generated by light deflected at the reflection face of the polygon minor 2104 along the time line is referred to as "plane of deflection" as described in JP-H11-202252-A. In this disclosure, the plane of deflection is a plane parallel to the X-Y plane.

Figure 4:
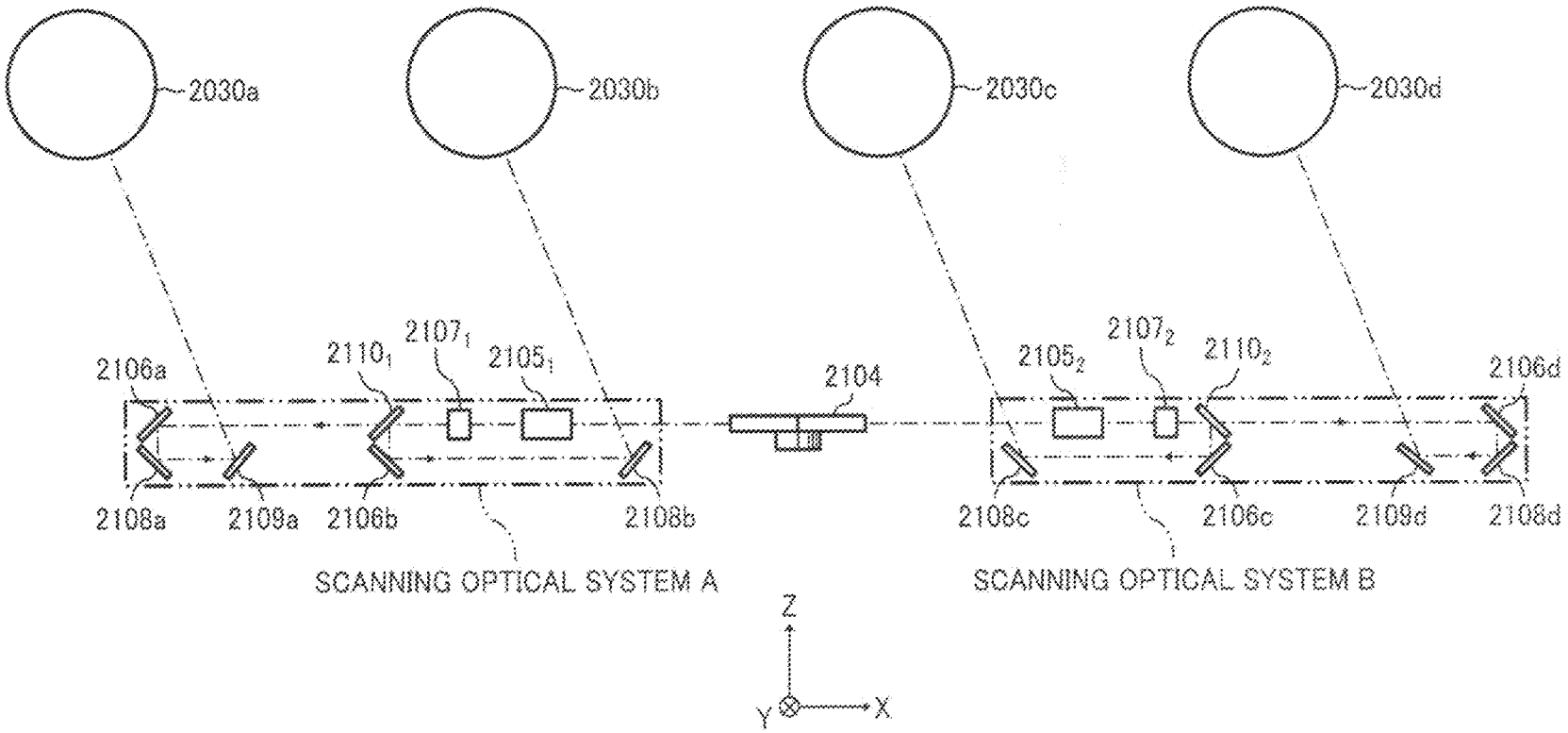
FIG. 4 shows two scanning optical systems shown in FIG. 2.

As shown in FIG. 4, the scanning optical system A includes, for example, a first scan lens $\mathbf{2105}_1$, a second scan lens $\mathbf{2107}_1$, a polarization splitter $\mathbf{2110}_1$, and five reflection mirrors 2106*a*, 2106*b*, 2108*a*, 2108*b*, 2109*a*. The first scan lens $\mathbf{2105}_1$ is disposed near to the optical deflector such as the polygon mirror, and the second scan lens $\mathbf{2107}_1$ is disposed near to the image bearing member such as the photoconductor in the optical path of the light.

The first scan lens $\mathbf{2105}_1$ is disposed at the −X side of the polygon minor 2104, and is disposed on the optical paths of the light LBa and the light LBb coming from the cylindrical lens $\mathbf{2204}_1$ deflected by the polygon mirror 2104.

The second scan lens $\mathbf{2107}_1$ is disposed at the −X side of the first scan lens $\mathbf{2105}_1$, and is disposed on the optical paths of the light LBa and the light LBb via the first scan lens $\mathbf{2105}_1$.

The polarization splitter $\mathbf{2110}_1$ is disposed at the −X side of the second scan lens $\mathbf{2107}_1$, and is disposed on the optical paths of the light LBa and the light LBb via the second scan lens $\mathbf{2107}_1$.

The polarization splitter $\mathbf{2110}_1$ has a polarized light separation face. The polarized light separation face is, for example, a wire grid, a multi-layered dielectric film or the like. The multi-layered dielectric film is preferably used to suppress the increase of wavefront aberration.

Further, the polarization splitter $\mathbf{2110}_1$ may be a quadrangular prism composed of two triangular prisms made of glass or resin material having a cross-sectional face of isosceles right triangle having interposing the polarized light separation face between the triangular prisms. The polarization splitter can be prepared with less processing using a plate member made of glass or transparent resin material as a base member, and forming the polarized light separation face on one side of the plate member.

Figure 5:
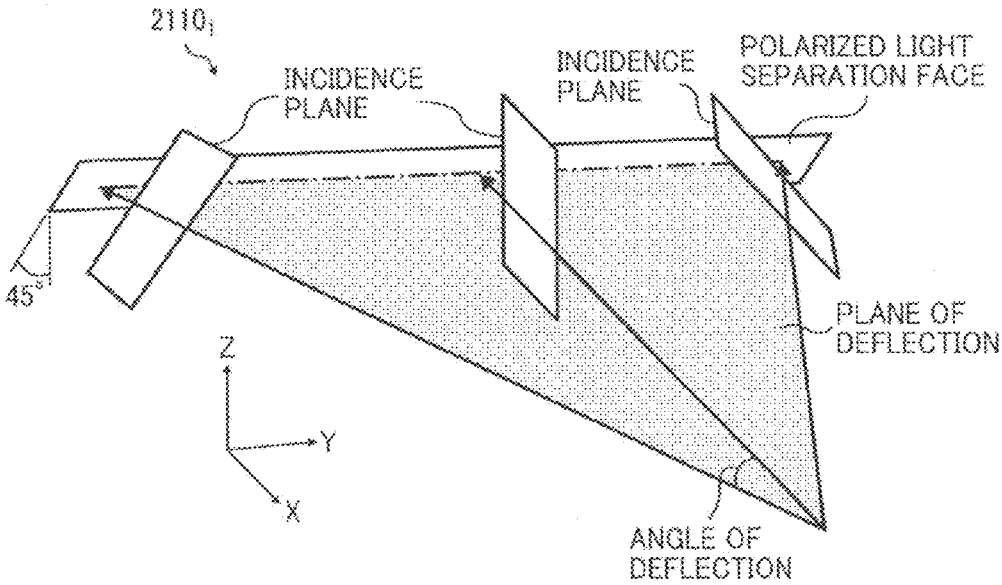
FIG. 5 shows a polarized light separation face of a polarization splitter.

As shown in FIG. 5, the polarization splitter $\mathbf{2110}_1$ includes, for example, a polarized light separation face which is angled 45° with respect to the plane of deflection.

Figure 6:
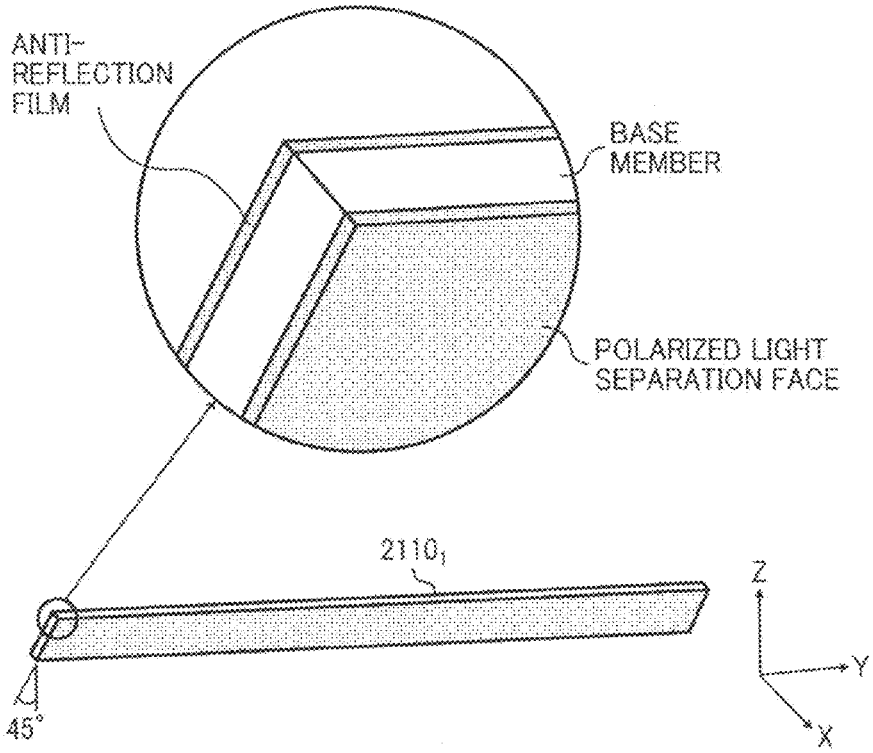
FIG. 6 shows an anti-reflection film of the polarization splitter.
Figure 7:
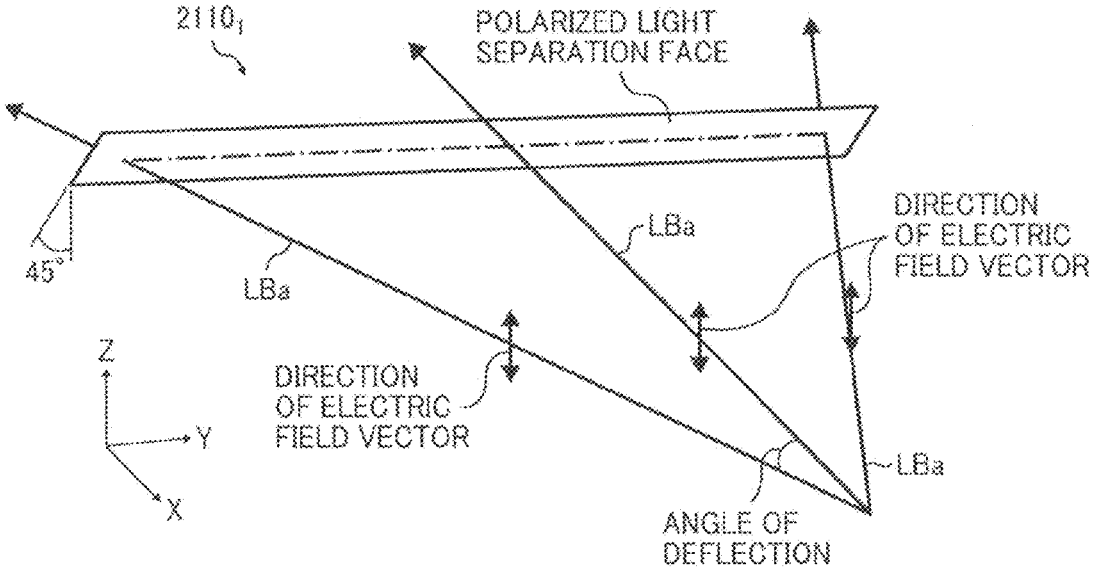
FIG. 7 shows an effect of a polarization splitter.

As shown in FIG. 6, a anti-reflection film is formed on a face of the polarization splitter $\mathbf{2110}_1$ opposite to the polarized light separation face. By providing the anti-reflection film, the separated light that has passed through the base member does not reflect on a rear face of the base member, by which the generation of ghost light can be suppressed.

Figure 8:
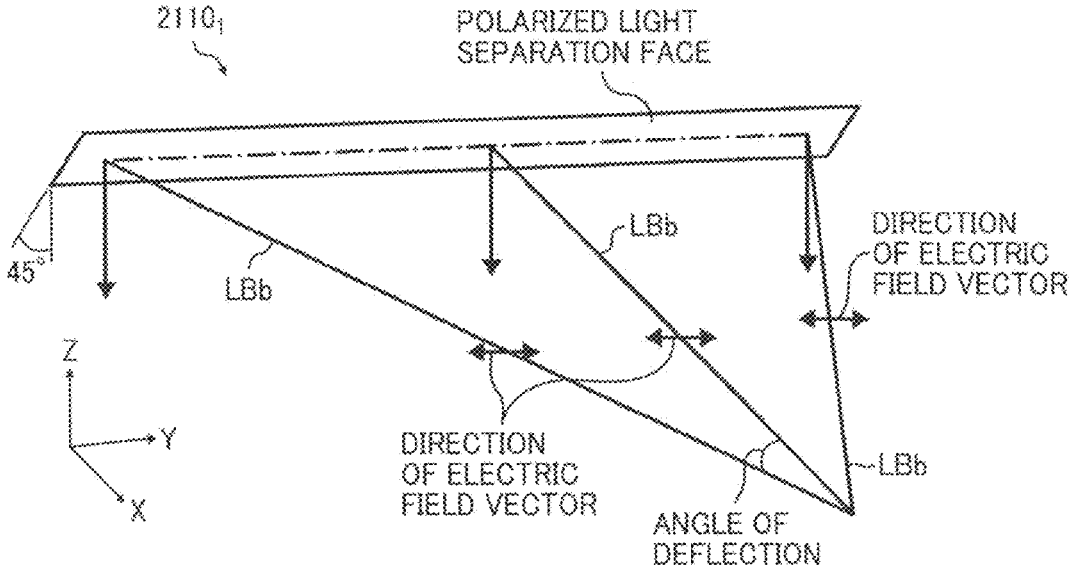
FIG. 8 shows another effect of a polarization splitter.

The polarization splitter $\mathbf{2110}_1$ passes through the light LBa (FIG. 7), and reflects the light LBb in the −Z direction (FIG. 8).

Referring back to FIG. 4, the light LBa that has passed through the polarization splitter $\mathbf{2110}_1$ is guided to the surface of the photoconductor drum 2030*a* via three reflection mirrors 2106*a*, 2108*a*, 2109*a*. Further, the light LBb reflected by the polarization splitter $\mathbf{2110}_1$ is guided to the surface of the photoconductor drum 2030*b* via two reflection mirrors 2106*b*, 2108*b*. *The first scan lens* $\mathbf{2105}_1$ and the second scan lens $\mathbf{2107}_1$ are used by two image forming stations.

The scanning optical system B includes, for example, the first scan lens $\mathbf{2105}_2$, the second scan lens $\mathbf{2107}_2$, the polarization splitter $\mathbf{2110}_2$, and five reflection mirrors 2106*c*, 2106*d*, 2108*c*, 2108*d*, 2109*d*.

The first scan lens $\mathbf{2105}_2$ is disposed at the +X side of the polygon mirror 2104, and is disposed on the optical paths of the light LBc and the light LBd coming from the cylindrical lens $\mathbf{2204}_2$ and deflected by the polygon mirror 2104.

The second scan lens $\mathbf{2107}_2$ is disposed at the +X side of the first scan lens $\mathbf{2105}_2$, and is disposed on the optical paths of the light LBc and the light LBd via the first scan lens $\mathbf{2105}_2$.

The polarization splitter $\mathbf{2110}_2$ is disposed at the +X side of the second scan lens $\mathbf{2107}_2$, and is disposed on the optical paths of the light LBc and the light LBd via the second scan lens $\mathbf{2107}_2$. The polarization splitter $\mathbf{2110}_2$ and the polarization splitter $\mathbf{2110}_1$ are the same type of polarization splitter.

The polarization splitter $\mathbf{2110}_2$ passes through the light LBd, and reflects the light LBc in the −Z direction.

The light LBc reflected by the polarization splitter $\mathbf{2110}_2$ is guided to the surface of the photoconductor drum 2030*c* via two reflection mirrors 2106*c*, 2108*c*.

The light LBd that has passed the polarization splitter $\mathbf{2110}_2$ is guided to the surface of the photoconductor drum 2030*d* via three reflection mirrors 2106*d*, 2108*d*, 2109*d*.

The first scan lens $\mathbf{2105}_2$ and the second scan lens $\mathbf{2107}_2$ are used by two image forming station.

The light spot on each of the photoconductor drums moves along the long side direction of the photoconductor drum as the polygon mirror 2104 rotates. The moving direction of the light spot corresponds to the main scanning direction, and the rotation direction of the photoconductor drum corresponds to the sub-scanning direction.

Figure 9:
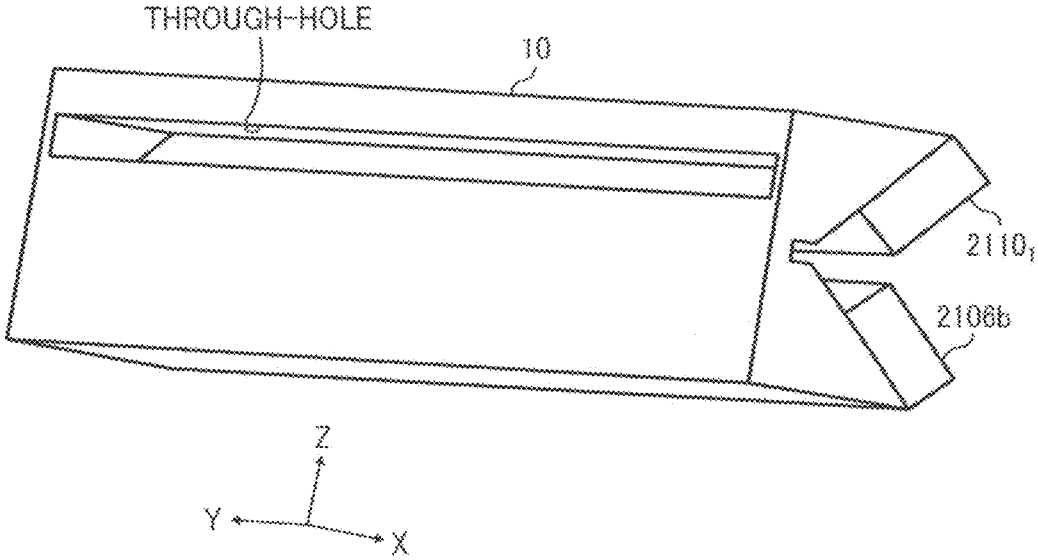
FIG. 9 shows a first holder holding a polarization splitter and a reflection mirror.

As shown in FIG. 9, the polarization splitter $\mathbf{2110}_1$ and a reflection mirror 2106*b* are retained integrally, for example, in a first holder 10.

Figure 10:
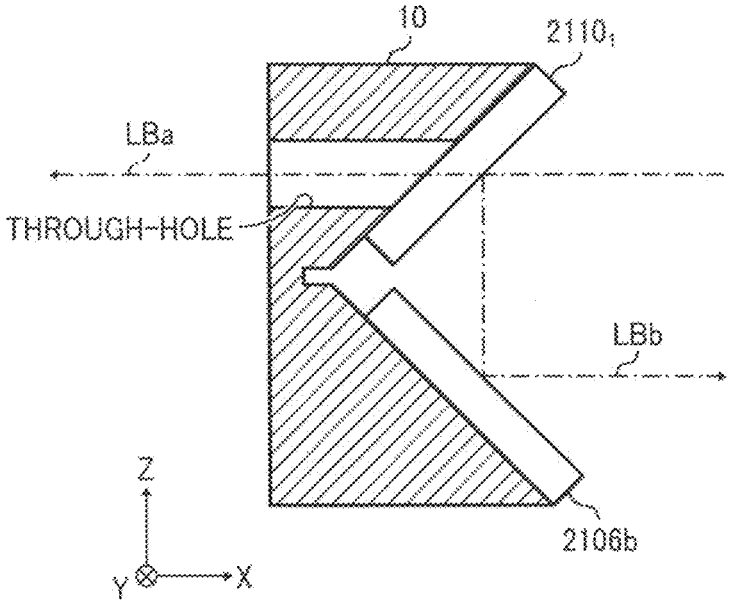
FIG. 10 shows a cross-sectional view of the first holder of FIG. 9.

As shown in FIG. 10, which is a cross-sectional view of FIG. 9, the first holder 10 integrally retains the polarization splitter $\mathbf{2110}_1$ and the reflection mirror 2106*b* while the polarization splitter $\mathbf{2110}_1$ and the reflection mirror 2106*b* are disposed within the first holder 10 in the Z axis direction.

The first holder 10 is, for example, a die-cast aluminum having two faces perpendicular with each other and extending along the long side direction (or Y axis direction), by which forming a right-angled face as described in JP-H06-50739-A. The polarization splitter $\mathbf{2110}_1$ is retained on the +Z side face in the right-angled face, and the reflection mirror 2106*b* is retained on the −Z side face in the right-angled face. Further, the first holder 10 is formed with a through-hole having a rectangular shape to pass the light LBa through the polarization splitter $\mathbf{2110}_1$.

The polarization splitter $\mathbf{2110}_1$ and the reflection minor 2106*b* are pressed against the right-angled face at a plurality of portions along the long side direction (or Y axis direction) using plate springs, or the polarization splitter $\mathbf{2110}_1$ and the reflection minor 2106*b* are adhered on the right-angled face using adhesive agent. With such a configuration, the rigidity of the polarization splitter 2110$_1$ and the reflection mirror 2106*b* can be made more rigid than setting the polarization splitter 2110$_1$ or the reflection mirror 2106*b* alone, and the natural frequency of the polarization splitter 2110$_1$ and the reflection mirror 2106*b* shifts to the high frequency side. Therefore, resonance by external vibrations can be suppressed, and an anti-vibration performance can be enhanced.

Further, because the polarization splitter 2110$_1$ and the reflection mirror 2106*b* are retained on the right-angled face, even if the dihedral angle is deviated from 90° due to manufacturing error or the like, the light progressing direction reflected by the reflection mirror 2106*b* (+X direction) does not change. If a reflection mirror alone is disposed conventionally, when the angle of a mirror face changes from the designed angel for θ, the light progressing direction reflected by the mirror face changes from the designed direction for 2θ.

Figure 11:
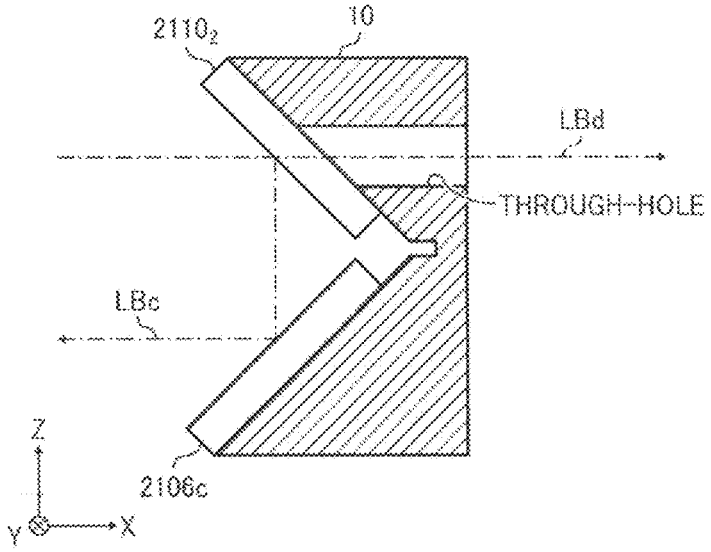
FIG. 11 shows another first holder holding a polarization splitter and a reflection mirror.

Further, as shown in FIG. 11, the polarization splitter 2110$_2$ and a reflection mirror 2106*c* are retained integrally, for example, in the first holder 10. With such a configuration, the polarization splitter 2110$_2$ and the reflection mirror 2106*c* can be made more rigid than setting the polarization splitter 2110$_2$ or the reflection mirror 2106*c* are alone, and the natural frequency of the polarization splitter 2110$_2$ and the reflection mirror 2106*c* shifts to the high frequency side. Therefore, resonance by external vibrations can be suppressed, and an anti-vibration performance can be enhanced.

Figure 12:
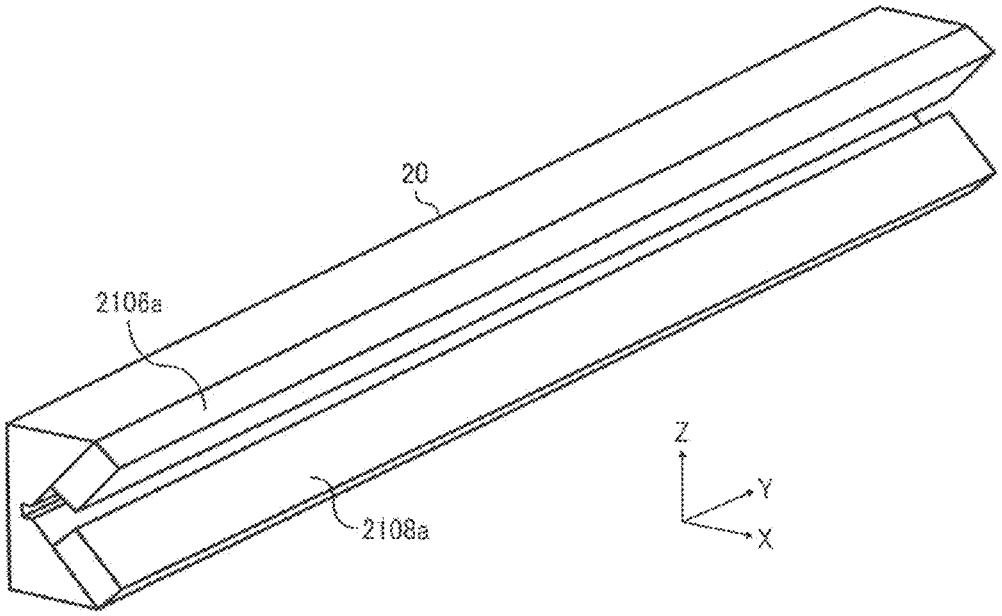
FIG. 12 shows a second holder holding two reflection mirrors.

Further, as shown in FIG. 12, a reflection mirror 2106*a* and a reflection mirror 2108*a* are retained integrally, for example, in a second holder 20.

Figure 13:
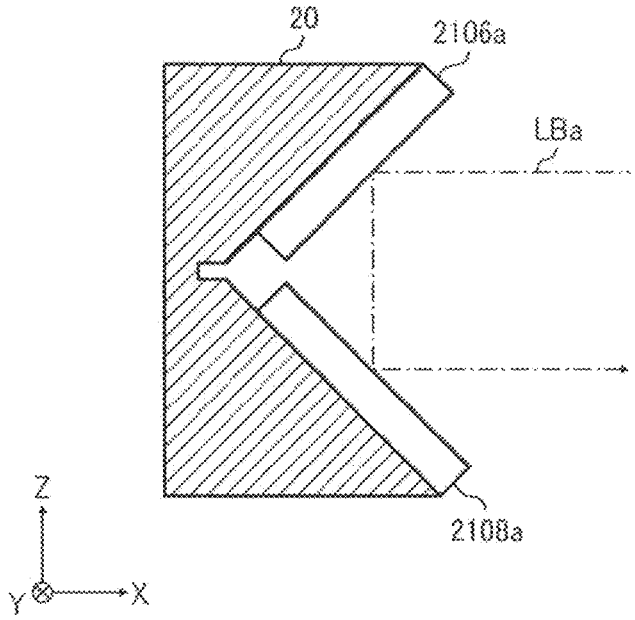
FIG. 13 shows a cross-sectional view of the second holder of FIG. 12.

As shown in FIG. 13, which is a cross-sectional view of FIG. 12, the second holder 20 integrally retains the reflection mirror 2106*a* and the reflection mirror 2108 while the reflection mirror 2106*a* and the reflection mirror 2108*a* are disposed within the second holder 20 in the Z axis direction.

The second holder 20 is, for example, a die-cast aluminum having two faces perpendicular with each other and extending along the long side direction (or Y axis direction), by which forming a right-angled face. The reflection mirror 2106*a* is retained on the +Z side face in the right-angled face, and the reflection mirror 2108*a* is retained on the −Z side face in the right-angled face.

The reflection mirror 2106*a* and the reflection mirror 2108*a* are pressed against the right-angled face at a plurality of portions along the long side direction (or Y axis direction) using plate springs, or the reflection mirror 2106*a* and the reflection mirror 2108*a* are adhered on the right-angled face using an adhesive agent. With such a configuration, the reflection mirror 2106*a* and the reflection mirror 2108*a* can be made more rigid than setting the reflection minor 2106*a* or the reflection mirror 2108*a* alone, and the natural frequency of the reflection mirror 2106*a* and the reflection mirror 2108*a* shifts to the high frequency side. Therefore, resonance by external vibrations can be suppressed, and an anti-vibration performance can be enhanced.

Figure 14:
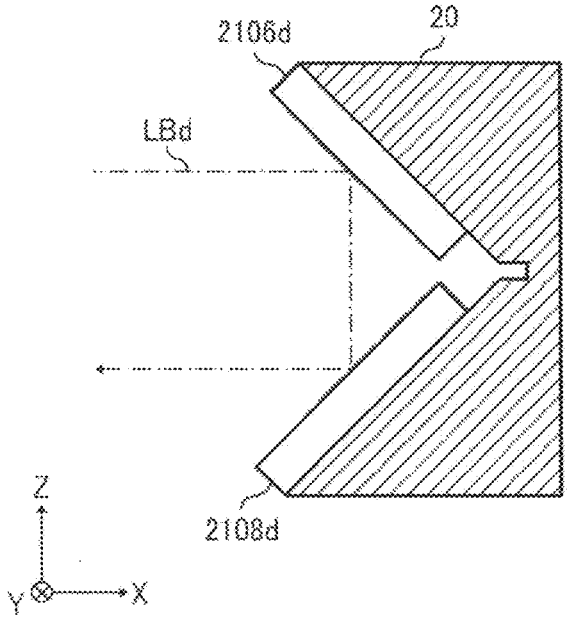
FIG. 14 shows another second holder holding two reflection mirrors two reflection mirrors.

Further, as shown in FIG. 14, a reflection minor 2106*d* and a reflection minor 2108*d* are retained integrally, for example, in the second holder 20. With such a configuration, the reflection mirror 2106*d* and the reflection minor 2108*d* can be made more rigid than setting the reflection mirror 2106*d* or the reflection mirror or 2108*d* alone, and the natural frequency of the reflection mirror 2106*d* and the reflection mirror 2108*d* shifts to the high frequency side. Therefore, resonance by external vibrations can be suppressed, and an anti-vibration performance can be enhanced.

FIG. 15 shows the optical housing 2300 attached with four light sources, the pre-deflector optical system, the polygon minor 2104, the scanning optical system A, and the scanning optical system B. The optical housing 2300 is made of, for example, a resin material having Young's modulus, for example, $1.25\times10^{10}$ (Pa). The optical housing 2300 is shaped, for example, as a box-shape having a top plate, a bottom plate, and four side plates, and the top plate is used as a cover. FIG. 15 shows the optical housing 2300 when the top plate is removed.

Further, the polygon minor 2104 is disposed at the center portion of the optical housing 2300. The bottom plate and the four side plates can be formed, for example, as one integral part.

Each end side of the optical housing 2300 in the Y axis direction can be fixed to a casing of the image forming apparatus 2000 via a stay 2401 (FIG. 15). The stay 2401 is made of, for example, a metal sheet, and has a long side along the X axis direction. The stay 2401 has a screw hole at its each end in the X axis direction so that the stay 2401 can be fixed to the casing of the image forming apparatus 2000 by screwing a screw through the screw hole.

Each of side plates of the optical housing 2300 disposed at each end in the Y axis direction is provided with a coupling member at each end in the X axis direction of the optical housing 2300, wherein the coupling member can be fixed with the stay 2401.

In the above-described example embodiment, the length of scanning optical system in the Z axis direction is set shorter using a polarization splitter, by which reducing the apparatus thickness of the optical scanner. Therefore, the height of side plates of the optical housing 2300 can be set smaller than the height of side plates of a conventional optical housing. If the height of the side plates is set smaller, the natural frequency of the optical housing decreases, by which the optical housing is more likely to resonate by external vibrations, wherein the external vibrations are transmitted to the optical housing 2300 via the coupling member fixed with the stay 2401.

In light of such vibration issues, as for the optical housing 2300 according to an example embodiment, a groove-formed portion having formed with a plurality of grooves is provided to the +Z side face of the bottom plate and a groove-formed portion having formed with a plurality of grooves is provided to the −Z side face of the bottom plate. Hereinafter, the +Z side face of the bottom plate may be referred to as the upper face or front face of the bottom plate, and the −Z side face of the bottom plate may be referred to as the lower face or rear face of the bottom plate. Further, the upper face of the bottom plate may be referred to as a first face, and the lower face or rear face of the bottom plate may be referred to as a second face, which are the opposite faces of one plate such as the bottom plate.

Figure 16:
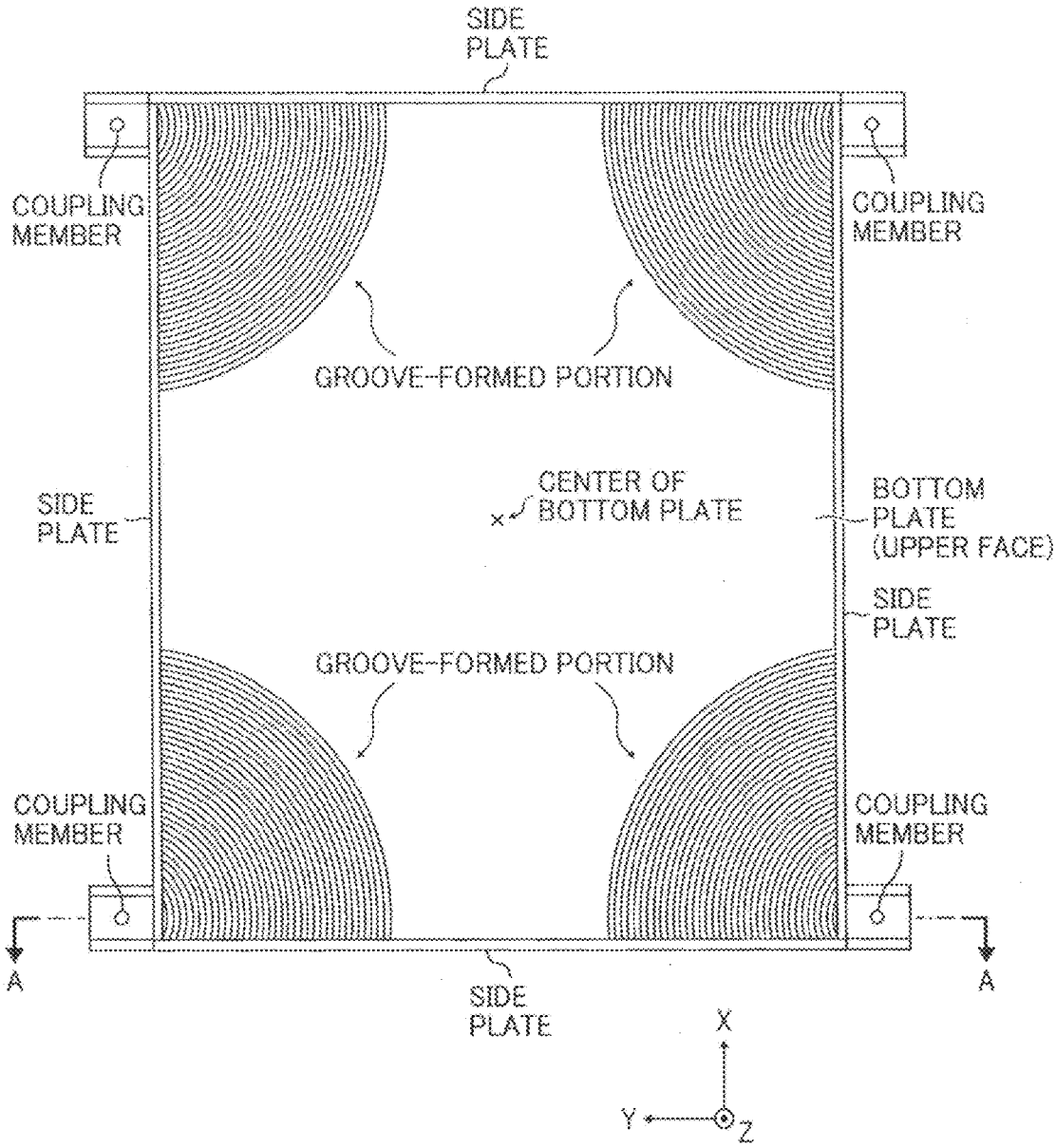
FIG. 16 shows a upper face of a bottom plate of the optical housing of FIG. 15.
Figure 17:
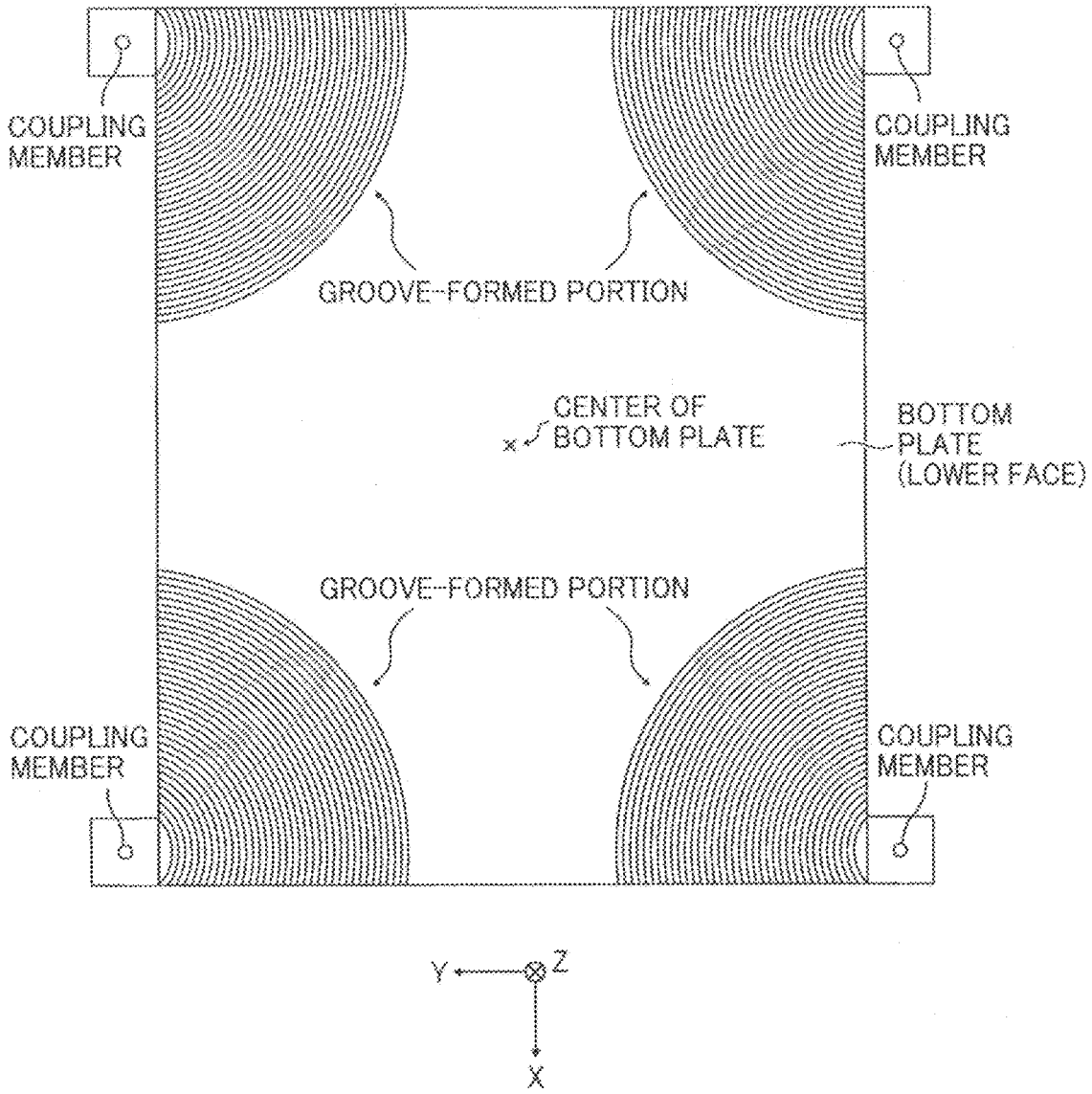
FIG. 17 shows a lower face of a bottom plate of the optical housing of FIG. 15.

FIG. 16 shows the groove-formed portion provided to the upper face of the bottom plate, and FIG. 17 shows the groove-formed portion provided to the lower face of the bottom plate. For example, the groove-formed portion is provided at each of four corners of the upper face of the bottom plate, and each of four corners of the lower face of the bottom plate.

Figure 18:
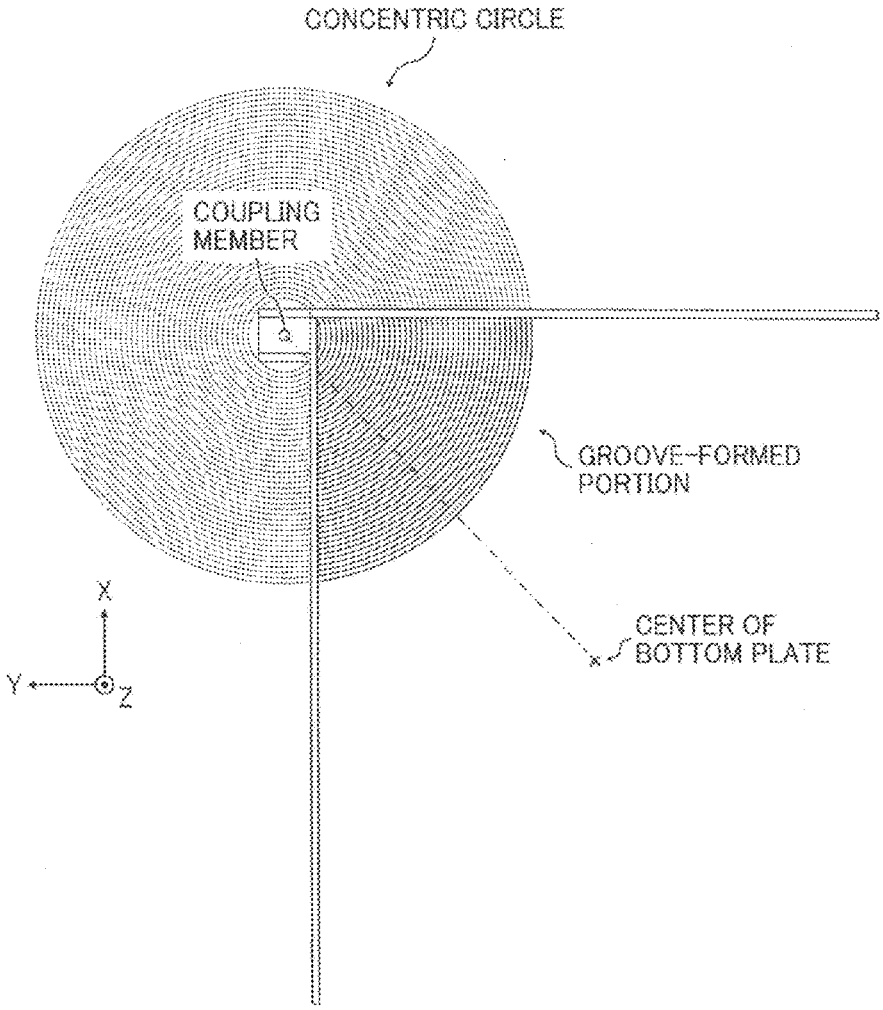
FIG. 18 shows an expanded view of a groove-formed portion.

The plurality of grooves at each of the groove-formed portions can be formed as arcs of concentric circles using the coupling member, fixable with the stay 2401 as their center or base point as shown in FIG. 18.

Figure 19:
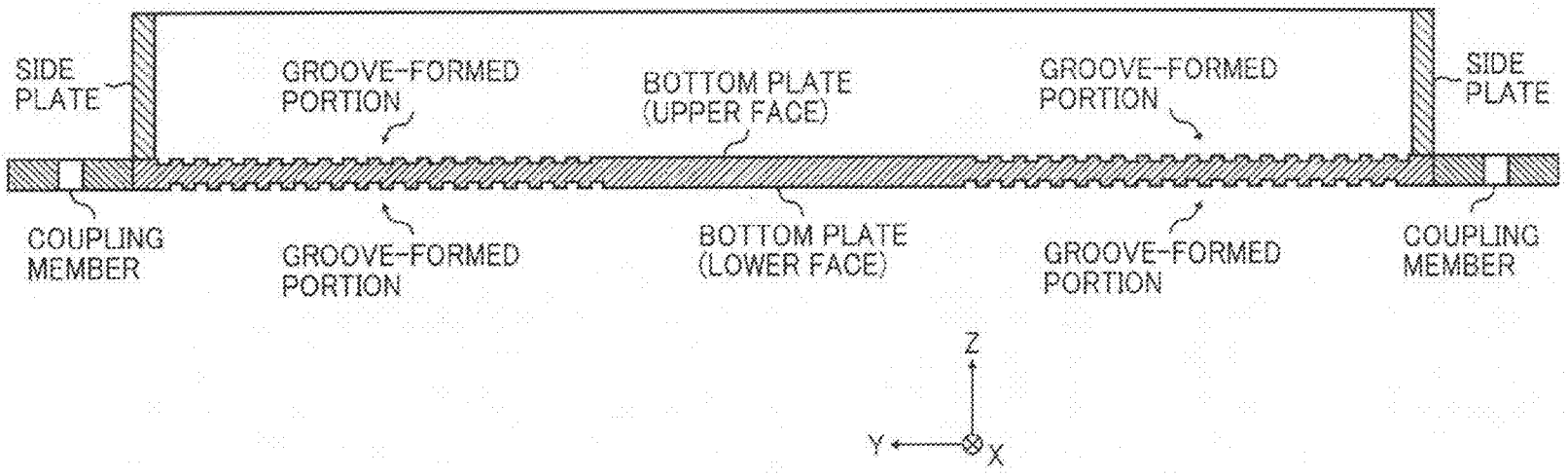
FIG. 19 shows a cross-sectional view of the optical housing of FIG. 16 cut at A-A line.
Figure 20:
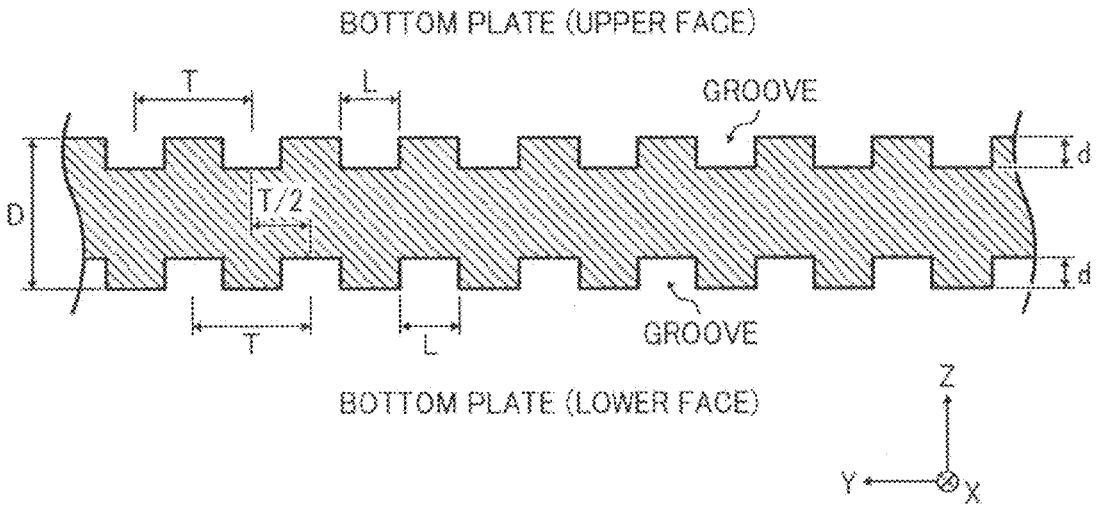
FIG. 20 an expanded view of the optical housing of FIG. 19.

FIG. 19 shows a shows a cross-sectional view of the optical housing 2300 along a line A-A in FIG. 16. Further, FIG. 20 shows a partially expanded view of the bottom plate of the optical housing 2300 of FIG. 19. As shown in FIG. 20, the shape of the groove along the YZ plane is, for example, rectangular. In the YZ cross-sectional plane, the plurality of grooves is formed with a pitch "T," a width of "L," and a depth of "d." Further, in the YZ cross-sectional plane, the center of the plurality of grooves formed on the upper face of the bottom plate and the center of the plurality of grooves formed on the lower face of the bottom plate are shifted for the length of half of pitch T (T/2). As shown in FIG. 20, the bottom plate has the thickness of "D."

For example, each of the groove-formed portions includes twenty grooves formed such that L=3 mm, d=0.75, T=6 mm for the bottom plate having thickness of D=2.5 mm.

To check the vibration reducing effect of the optical housing 2300, a random vibrational analysis using an analysis software such as ANSYS (a registered trademark of ANSYS, Inc.) is conducted. In such random vibrational analysis, acceleration is applied to the coupling member fixed with the stay 2401 along the Z axis direction for each of frequency range for causing vibrations, and the maximum deformation amount in the Z axis direction is computed.

Figure 21:
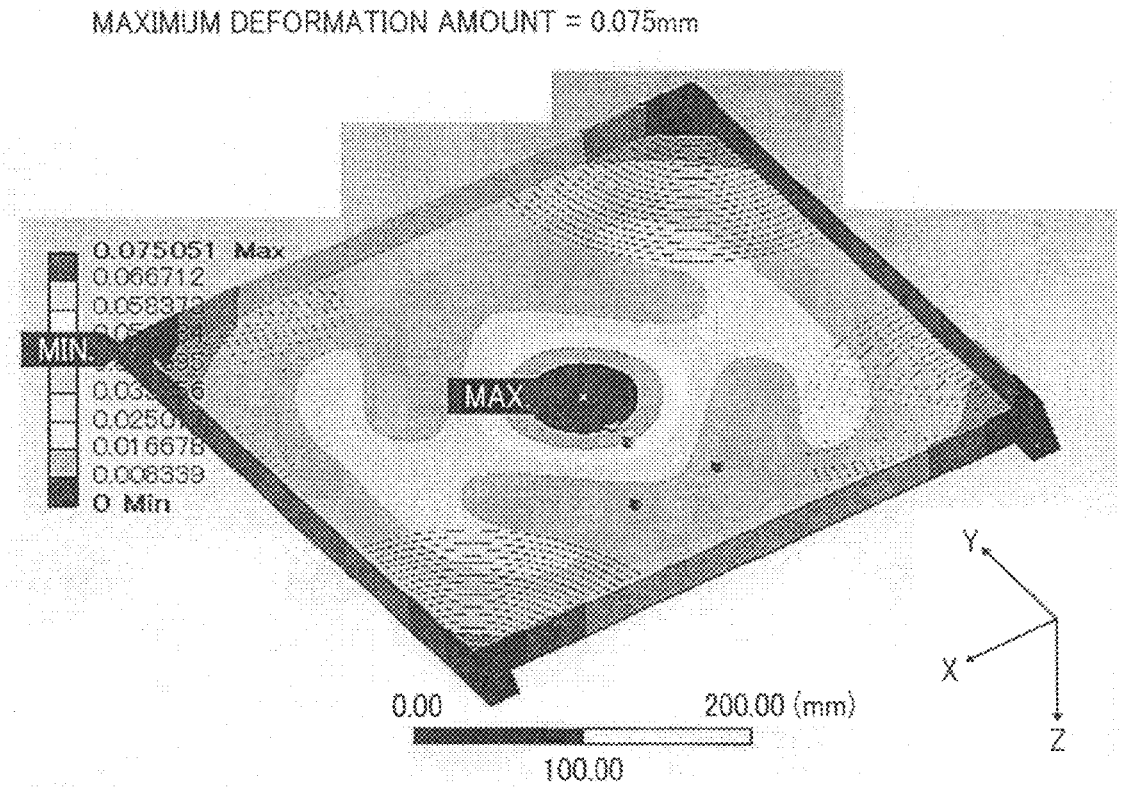
FIG. 21 shows a random vibrational analysis result for the optical housing according to an example embodiment.

As for the optical housing 2300, the greatest deformation occurs at substantially the center portion, and the maximum deformation amount was, for example, 0.075 mm (FIG. 21).

Figure 22:
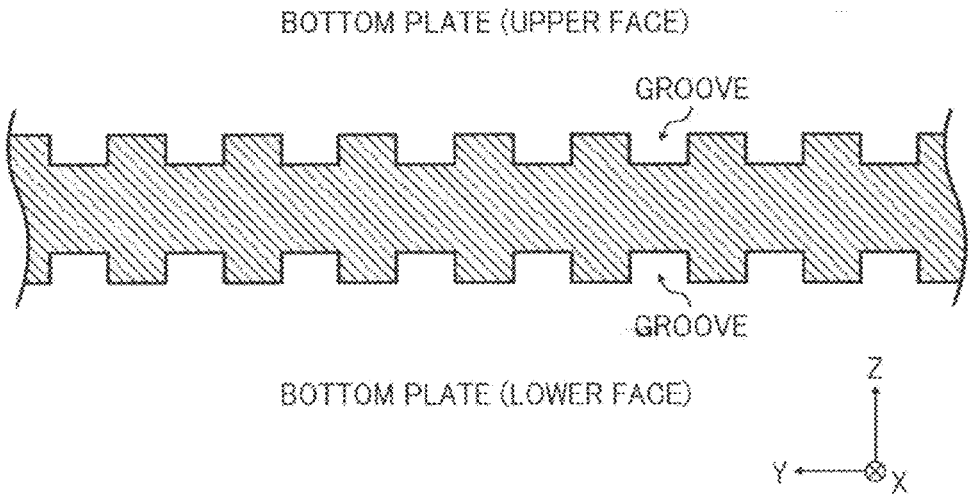
FIG. 22 shows an optical housing having formed of a plurality of grooves on the upper face of the bottom plate and the lower face of the bottom plate, and the plurality of grooves on the upper face and the lower are set at corresponding positions.
Figure 23:
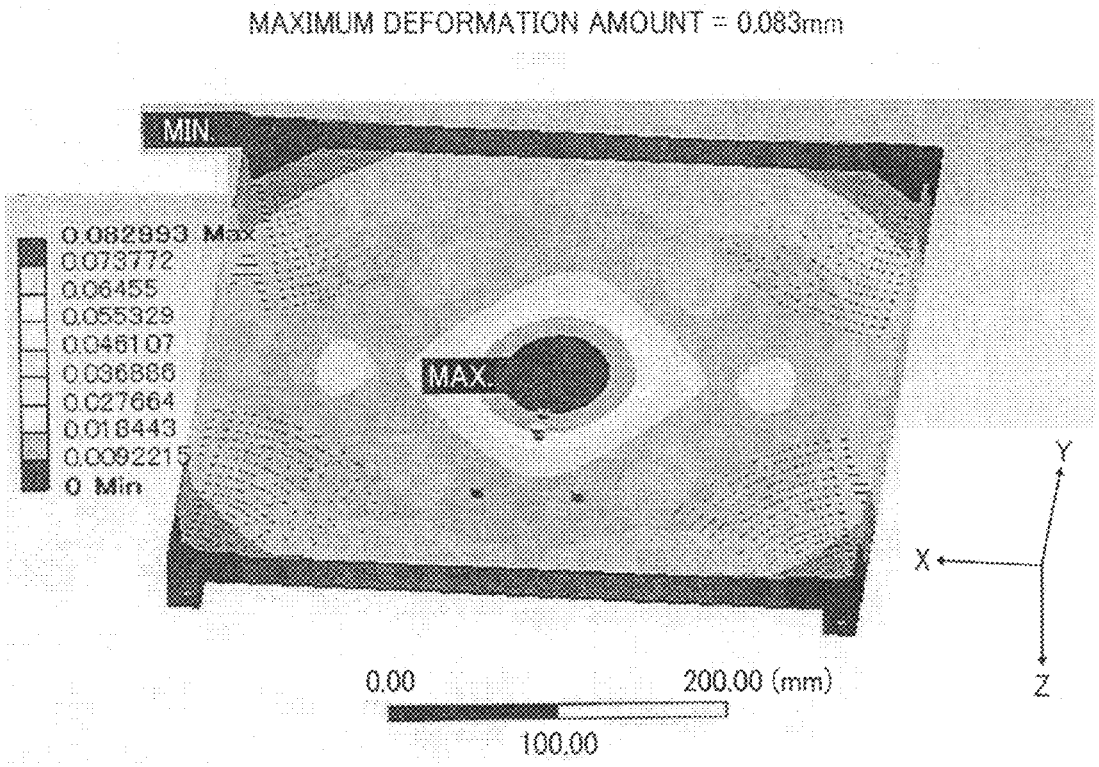
FIG. 23 shows a random vibrational analysis result for the optical housing of FIG. 22.

As shown in FIG. 22, the plurality of grooves formed on the upper face of the bottom plate and the plurality of grooves formed on the lower face of the bottom plate can be corresponded one by one, in which the center of the plurality of grooves formed on the upper face of the bottom plate and the center of the plurality of grooves formed on the lower face of the bottom plate are matched. In such a configuration, the maximum deformation amount was 0.083 mm (FIG. 23).

Figure 24:
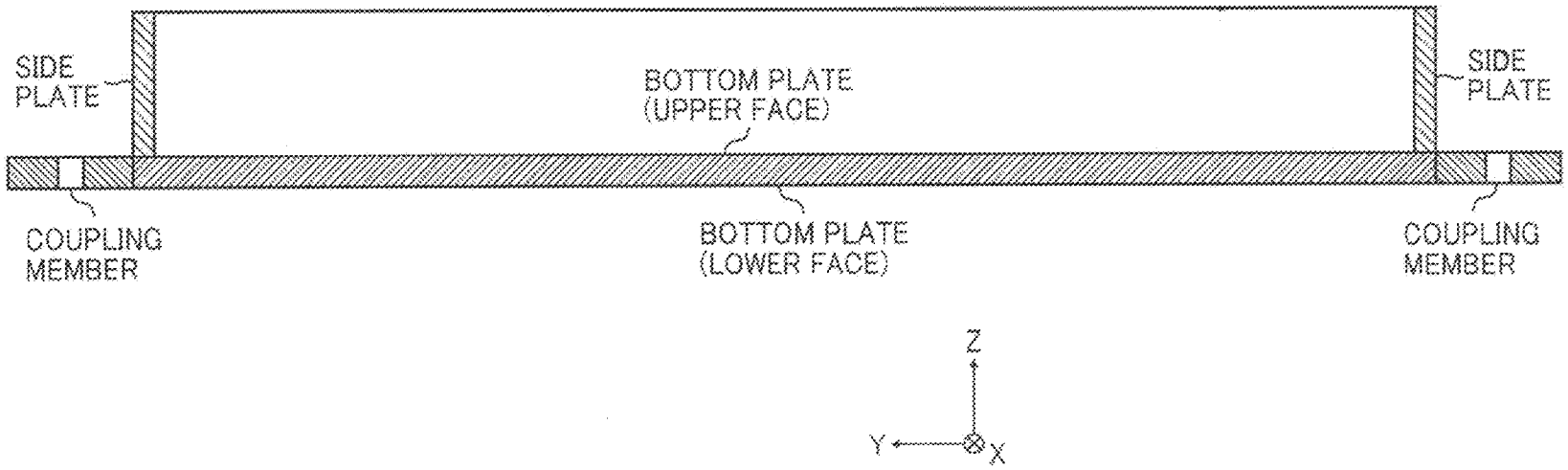
FIG. 24 shows a conventional optical housing.
Figure 25:
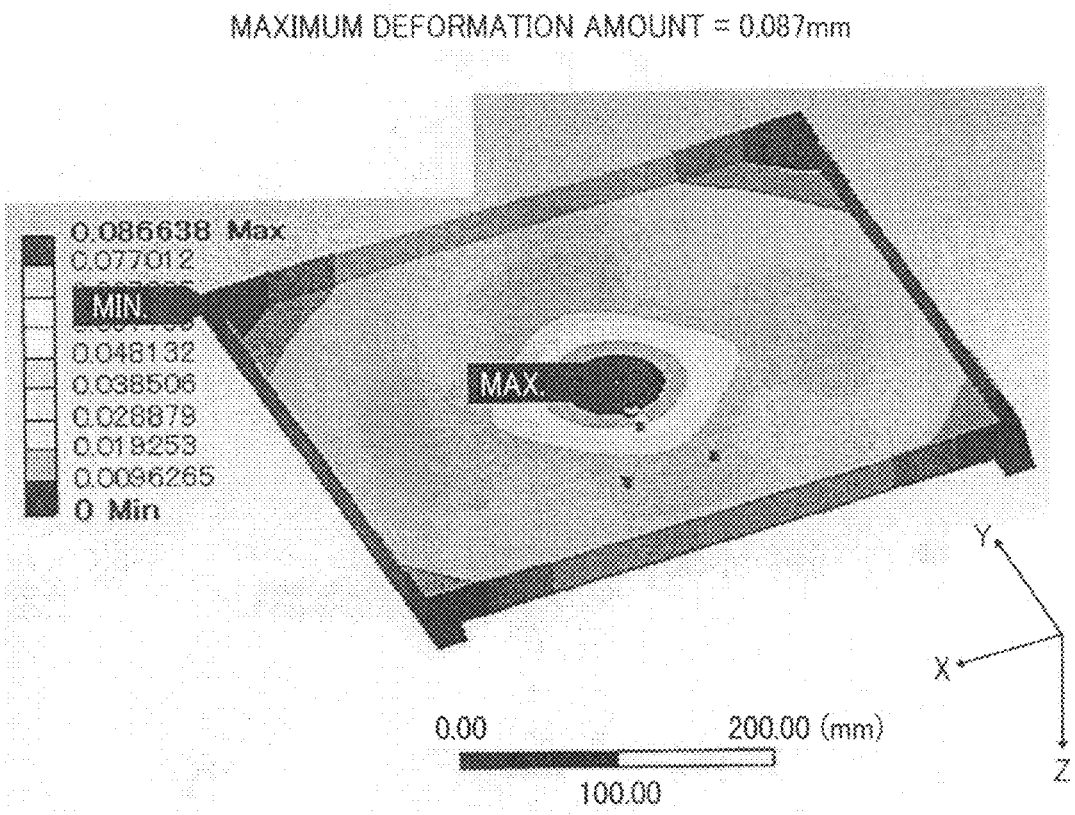
FIG. 25 shows a random vibrational analysis result for the optical housing of FIG. 24.

Further, as for a conventional optical housing without grooves shown in FIG. 24, the maximum deformation amount was 0.087 mm (FIG. 25).

Figure 26:
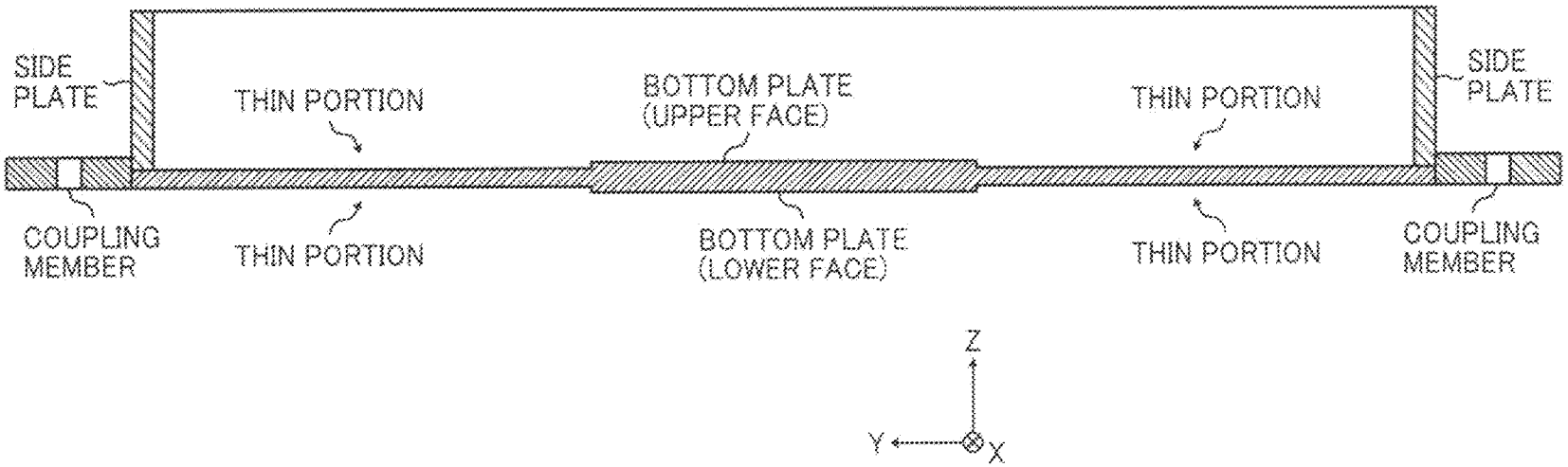
FIG. 26 shows an optical housing having thin portions at four corners.
Figure 27:
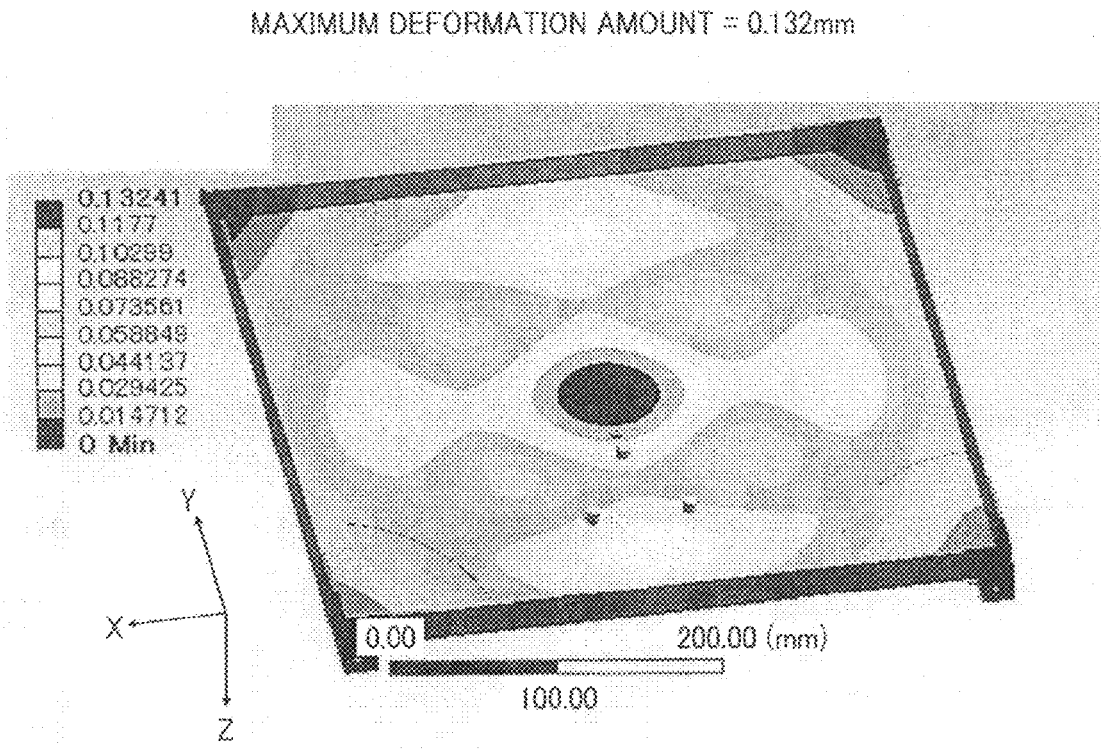
FIG. 27 shows a random vibrational analysis result for the optical housing of FIG. 26.

Further, to determine the effect of grooves, an optical housing having no grooves is prepared as shown in FIG. 26, in which the optical housing has a thin portion having 1 mm thickness at a portion corresponding to the groove-formed portion of the optical housing 2300. In such optical housing having no grooves, the maximum deformation amount was 0.132 mm (FIG. 27).

Figure 28:
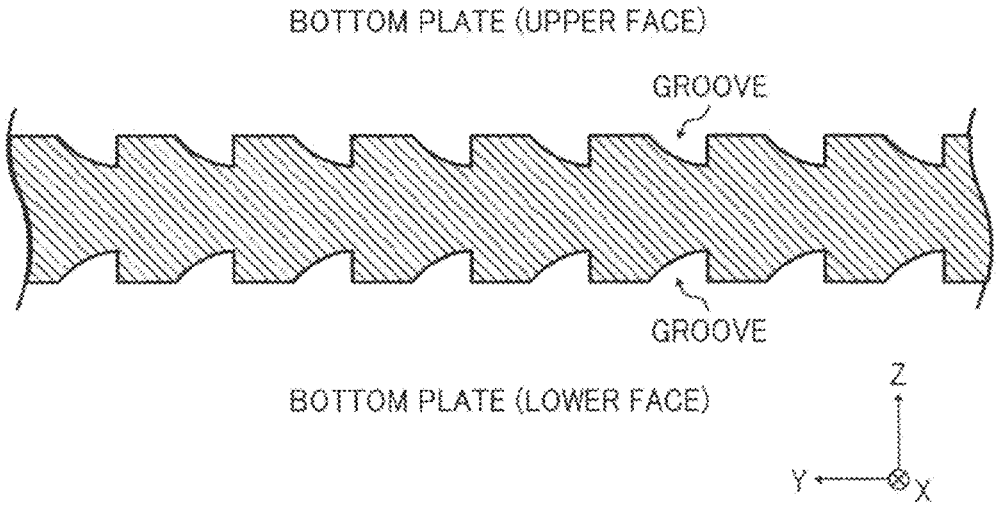
FIG. 28 shows an optical housing having concave and convex portions for reducing vibration transmission.
Figure 29:
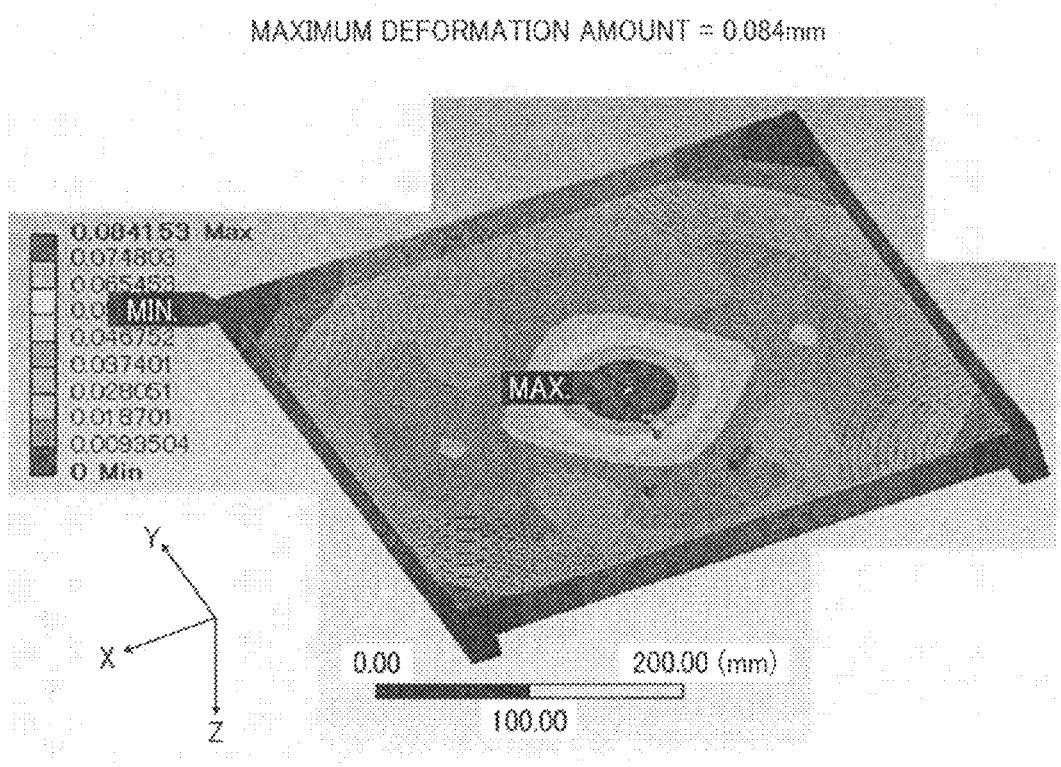
FIG. 29 shows a random vibrational analysis result for the optical housing of FIG. 28.

Further, instead of the groove-formed portion of the optical housing 2300, an optical housing can be formed with concave/convex portions used for reducing vibration transmission as shown in FIG. 28, which is disclosed in JP-4223175-B (JP-2002-023095-A). In such a configuration, the maximum deformation amount was 0.084 mm (FIG. 29).

Based on the comparison of maximum deformation amounts, which are the results of above-described vibrational analysis, the maximum deformation amount of the optical housing 2300 becomes the smallest one, and it is confirmed that such optical housing 2300 can reduce an effect of vibrations.

The anti-vibration performance of an optical housing can be enhanced by adding ribs. However, such optical housing will increase its weight, and its material cost. In an Example embodiment, the plurality of grooves are formed on the upper face of the bottom plate and the lower face of the bottom plate while shifting the positions of grooves formed on the upper face and the positions of grooves formed on the lower face for the half of pitch of grooves as shown in FIG. 20. For example, the groove formed on the upper face and the groove formed on the lower face of the bottom plate are shifted with each for a half of pitch T. With such a configuration, the anti-vibration performance of the optical housing can be enhanced without increasing weight and material cost. As such, even if the size of the scanning optical system in the Z axis direction becomes smaller, the optical housing can reduce its apparatus thickness while preventing or suppressing the decrease of the anti-vibration performance.

As above-described, the optical scan unit 2010 includes the four light sources 2200*a*, 2200*b*, 2200*c*, 2200*d*, the pre-deflector optical system, the polygon mirror 2104, the scanning optical system A , the scanning optical system B, and the optical housing 2300, wherein the optical housing 2300 is attached with such units or devices.

Each of scanning optical systems includes a polarization splitter that separates two lights having different polarization directions with each other. In such a configuration, the optical paths of such two lights deflected by the polygon mirror 2104 can be partially overlapped, by which the apparatus thickness of optical scanner can be reduced.

As for the optical housing 2300, the plurality of grooves is formed on the upper face of the bottom plate with an equal pitch, and the plurality of grooves is formed on the lower face of the bottom plate with an equal pitch. Further, the center of each of the grooves formed on the upper face of the bottom plate and the center of each of the grooves formed on the lower face of the bottom plate is shifted for the half of pitch of grooves. With such a configuration, even if the optical housing reduces its apparatus thickness, the anti-vibration performance of the optical housing can be enhanced without increasing weight and material cost. Therefore, the rigidity of the optical scan unit 2010 against mechanical disturbance can be enhanced.

Resultantly, the image forming apparatus 2000 can reduce its apparatus size without degrading image quality.

Further, in the above-described example embodiment, the plurality of grooves is formed on the bottom plate of the optical housing 2300, but the plurality of grooves can be formed on the side plate instead of the bottom plate, or the plurality of grooves can be formed on both of the bottom plate and the side plate.

Further, in the above-described example embodiment, the shape of grooves in the plane parallel to the Z axis is rectangular, but the shape of grooves is not limited to the rectangular.

Further, in the above-described example embodiment, the grooves formed on the upper face of the bottom plate and the grooves formed on the lower face of the bottom plate are shifted for T/2. However, the shifting distance is not limited to T/2. Specifically, if the center of each of the the grooves formed on the upper face of the bottom plate and the center of each of the the grooves formed on the lower face of the bottom plate are shifted for a given distance, such optical housing has the above-described effect.

Further, in the above-described example embodiment, the plurality of grooves is formed as arc of a concentric circle setting the coupling member as the center of the concentric circle (see FIG. 18), but the center of the concentric circle is not limited to the coupling member fixed with the stay 2401, which means the center of the concentric circle can be deviated from the coupling member. Further, the plurality of grooves is not limited to the arc pattern. For example, the plurality of grooves can be formed with straight lines.

Further, in the above-described example embodiment, the plurality of grooves is formed with an equal pitch, but the pitch is not limited to the equal pitch.

Figure 30:
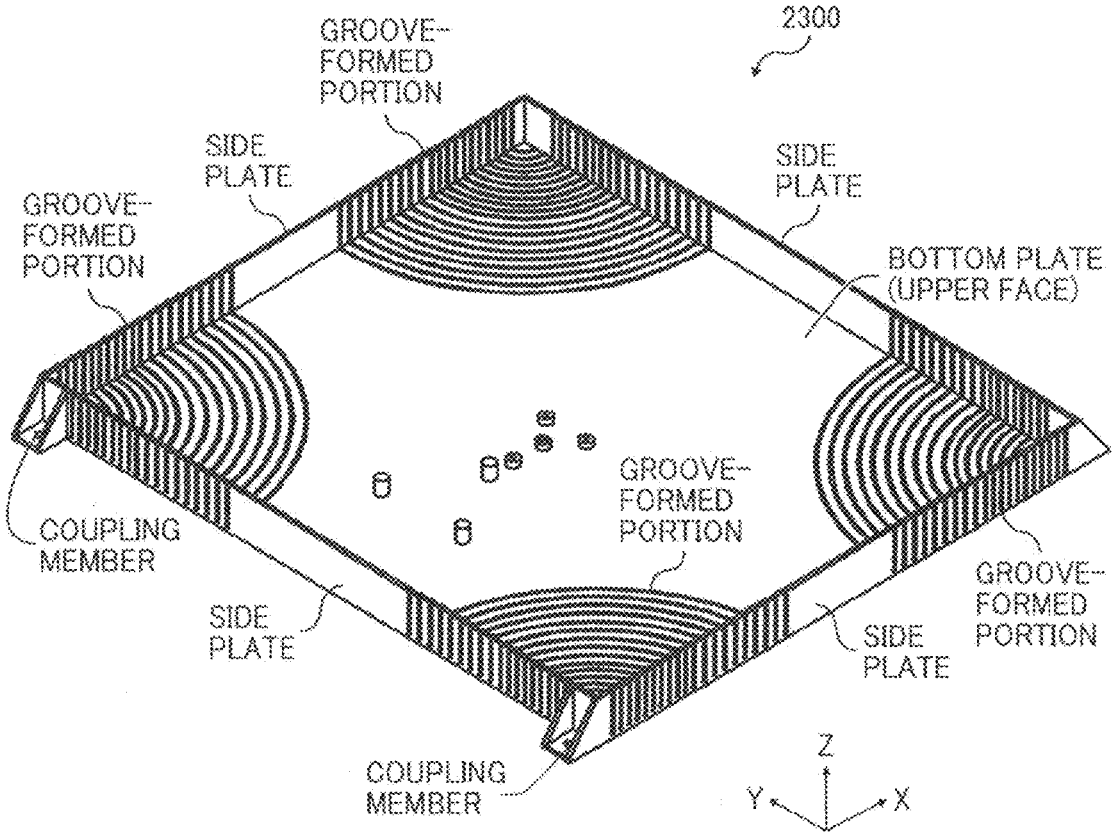
FIG. 30 shows an optical housing formed of a plurality of grooves on a bottom plate and a side plates.

Further, in the above-described example embodiment, the plurality of grooves is formed on the bottom plate of the optical housing 2300, but the plurality of grooves can be formed differently. For example, the plurality of grooves can be formed on the side plate of the optical housing 2300 instead of the bottom plate, or the plurality of grooves can be formed on both of the bottom plate and the side plate as shown in FIG. 30. Further, the plurality of grooves can be formed on the top plate of the optical housing 2300 instead of the bottom plate, or the plurality of grooves can be formed on both of the bottom plate and the top plate.

Further, in the above-described example embodiment, the number of grooves, the groove width L, the groove depth d, and the groove pitch T can be set any values.

Further, in the above-described example embodiment, the first holder 10 and the second holder 20 are die-cast aluminum, but the first holder 10 and the second holder 20 can be made of other materials. For example, the first holder 10 and the second holder 20 can be formed by machining, by metal sheet processing, or can be formed using metal material other than aluminum, or can be formed using resin material. For example, the first holder 10 and the second holder 20 can be formed by the injection molding using resin material.

Further, the shape of the first holder 10 and the shape of the second holder 20 perpendicular to the Y axis direction are not limited to the above described shape. Further, the size of the first holder 10 and the second holder 20 is not limited to the above described size. As long as the first holder 10 integrally retains a polarization splitter and a reflection mirror while the polarization splitter and the reflection mirror are disposed within the first holder 10 in the Z axis direction, and further, as long as the second holder 20 integrally retains two reflection mirrors in the Z axis direction while the two reflection mirrors are disposed within the second holder 20 in the Z axis direction, the optical system can be used effectively.

Figure 31:
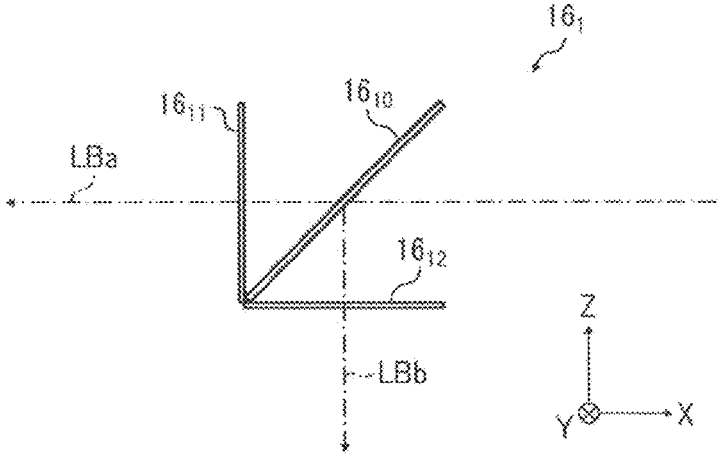
FIG. 31 shows an example of a polarized light separation device.

Further, in the above-described example embodiment, the polarization splitter $\mathbf{2110}_1$ is used. Instead of the polarization splitter $\mathbf{2110}_1$, as shown in FIG. 31, a polarized light separation device $\mathbf{16}_1$ can be used. The polarized light separation device $\mathbf{16}_1$ includes a beam splitter $\mathbf{16}_{10}$, and two polarizers $\mathbf{16}_{11}$, $\mathbf{16}_{12}$.

The beam splitter $\mathbf{16}_{10}$ is disposed at the −X side of the second scan lens $\mathbf{2107}_1$ and is disposed on the optical paths of the light LBa and the light LBb via the second scan lens $\mathbf{2107}_1$. The beam splitter $\mathbf{16}_{10}$ passes through one polarized light in the incidence light and reflects other polarized light in the incidence light while maintaining the polarization direction of the incidence lights.

The polarizer $\mathbf{16}_{11}$ is disposed at the −X side of the beam splitter $\mathbf{16}_{10}$ and is disposed on the optical path of the light that has passed the beam splitter $\mathbf{16}_{10}$. The polarizer $\mathbf{16}_{12}$ is disposed at the −Z side of the beam splitter $\mathbf{16}_{10}$ and is disposed on the optical path of the light reflected by the beam splitter $\mathbf{16}_{10}$. Each of the polarizers may be a polarization film, which can be prepared by dyeing the film with iodine or dichroic dye and extending such film in one direction.

Only the light LBa passes through the polarizer $\mathbf{16}_{11}$, and only the light LBb passes through the polarizer $\mathbf{16}_{12}$.

Further, another polarized light separation device can be used instead of the polarization splitter $\mathbf{2110}_2$.

Further, in the above-described example embodiment, each light source includes one light emitting element, but the number of light emitting elements is not limited one. For example, each light source can include a plurality of semiconductor lasers. Further, each light source can include a semiconductor laser array having a plurality of light emitting elements.

Further, in the above-described example embodiment, the image forming apparatus of color printer having the four photoconductor drums is described, but the image forming apparatus is not limited such color printer.

Further, in the above-described example embodiment, the optical scanner is used for printers, but the optical scanner can be used for other image forming apparatuses such as copiers, facsimile machines, or multi-functional apparatuses combining such machines.

Further, in the above-described example embodiment, in the image forming apparatus, the surface of an image carrier is optically scanned to form a latent image on the surface of the image carrier, but the image forming apparatus that can form a latent image on the surface of an image carrier without the optical scanning can be used.

As for the above described exposure device, the rigidity of the exposure device against mechanical disturbance can be enhanced.

Numerous additional modifications and variations are possible in light of the above teachings. It is therefore to be understood that, within the scope of the appended claims, the disclosure of the present invention may be practiced otherwise than as specifically described herein. For example, elements and/or features of different examples and illustrative embodiments may be combined each other and/or substituted for each other within the scope of this disclosure and appended claims.

What is claimed is:

1. An exposure device to expose an exposure element, comprising:

a light source;

an optical system to guide light emitted from the light source in an optical path to the exposure element; and an optical housing, configured with a plurality of plates, to support the light source and the optical system, wherein a least one of the plurality of plates configuring the optical housing is formed with a plurality of grooves on each of a first face and a second face with a given pitch on the one of the plurality of plates, the first face and the second face being opposite faces with each other, wherein each of the grooves has a rectangular cross-sectional shape, wherein the plurality of grooves are arranged by shifting the center of each of the grooves formed on the first face and the center of each of the grooves formed on the second face by substantially one half of said given pitch, whereby an amplitude of vibrations of the optical housing are reduced.

2. The exposure device of claim 1, wherein the optical housing and the exposure element are encased in a casing, wherein the optical housing has a coupling member coupled with the casing, wherein the plurality of grooves is arranged on the first face and the second face using the coupling member as a base point of the plurality of grooves.

3. The exposure device of claim 2, wherein the plurality of grooves formed on the first face and the second face form arcs of concentric circles having the coupling member as substantially the center of the concentric circles.

4. The exposure device of claim 2, wherein the plurality of grooves formed on the first face and the second face is formed on a bottom plate of the optical housing, extending from the coupling member toward the center of the bottom plate.

5. The exposure device of claim 1, wherein the optical system includes:

a pre-deflector optical system disposed on the optical path of light emitted from the light source;

an optical deflector to deflect light coming from the pre-deflector optical system; and a scanning optical system to focus the light deflected by the optical deflector onto a surface of the exposure element.

6. An image forming apparatus, comprising:

a plurality of image carriers; and the exposure device of claim 1 to expose the plurality of image carriers separately.

7. The exposure device of claim 1, wherein the at least one of the plurality of plates configuring the optical housing and formed with a plurality of grooves does not intersect with the optical path.

8. An exposure device to expose an exposure element, comprising:

a light source;

an optical system to guide light emitted from the light source in an optical path to the exposure element; and an optical housing, configured with a plurality of plates, to support the light source and the optical system, wherein a least one of the plurality of plates configuring the optical housing is formed with a plurality of grooves on each of a first face and a second face with a given pitch on the one of the plurality of plates, the first face and the second face being opposite faces with each other, wherein each of the grooves has a rectangular cross-sectional shape, wherein the plurality of grooves are arranged by shifting the center of each of the grooves formed on the first face and the center of each of the grooves formed on the second face by substantially one half of said given pitch, wherein the plurality of grooves formed on the first face and second face is formed on a side plate of the optical housing.

* * * * *